US010947719B1

(12) United States Patent
Wodecki et al.

(10) Patent No.: US 10,947,719 B1
(45) Date of Patent: Mar. 16, 2021

(54) MODULAR HUT

(71) Applicant: GE Precision Healthcare LLC, Milwaukee, WI (US)

(72) Inventors: Lionel Wodecki, Maisons Alfort (FR); Marie Bachoc, Singapore (SG); Ludovic Avot, Croissy sur Seine (FR)

(73) Assignee: GE Precision Healthcare LLC, Milwaukee, WI (US)

( * ) Notice: Subject to any disclaimer, the term of this patent is extended or adjusted under 35 U.S.C. 154(b) by 0 days.

(21) Appl. No.: 16/583,074

(22) Filed: Sep. 25, 2019

(51) Int. Cl.

| | |
|---|---|
| ***E04B 1/346*** | (2006.01) |
| ***E04H 1/00*** | (2006.01) |
| ***E04H 1/12*** | (2006.01) |
| ***A47C 15/00*** | (2006.01) |

(52) U.S. Cl.
CPC ..... *E04B 1/346* (2013.01); *A47C 15/004* (2013.01); *E04H 1/005* (2013.01); *E04H 1/12* (2013.01)

(58) Field of Classification Search
CPC . E04B 1/346; E04B 1/343; E04H 1/12; E04H 1/1222; E04H 1/125; E04H 1/005; A47C 15/004; A47C 1/024; A47C 1/035; A61G 15/00; A61G 15/02
See application file for complete search history.

(56) References Cited

U.S. PATENT DOCUMENTS

| | | | | |
|---|---|---|---|---|
| 4,941,709 | A * | 7/1990 | Moller | A61B 6/04 297/311 |
| 8,087,724 | B2 * | 1/2012 | Kosik | A47C 3/0257 297/170 |
| 8,695,285 | B2 * | 4/2014 | Reinmann, Jr. | E04H 9/16 299/12 |
| 9,376,829 | B2 * | 6/2016 | King, III | E04H 9/14 |
| 9,708,829 | B2 * | 7/2017 | Faigen | B63C 9/06 |
| D831,988 | S * | 10/2018 | Passmore | D6/334 |
| 2013/0067834 | A1 * | 3/2013 | Downey | E04H 1/14 52/173.1 |

* cited by examiner

*Primary Examiner* — Andrew J Triggs
(74) *Attorney, Agent, or Firm* — McCoy Russell LLP

(57) ABSTRACT

Embodiments are provided for a modular experience hut that may provide semi-enclosed structures for use in public or semi-public areas such as medical facilities. In an example, a modular hut includes a base, a ring rotatably coupled to the base, a seat portion coupled to an inner surface the ring, and a locking mechanism configured to lock the ring in at least a first position and a second position relative to the base. In this way, the modular hut may be positioned in different positions to allow for different seating or use arrangements.

16 Claims, 14 Drawing Sheets

MODULAR HUT

FIELD

The present description relates generally to modular furniture, and more specifically to a modular experience hut configured to provide a semi-private space in a medical environment.

BACKGROUND

Many medical facilities, such as hospitals, clinics, or diagnostic imaging facilities, include waiting rooms where patients may wait for an upcoming medical procedure or appointment with a clinician. These waiting rooms are frequently large and impersonal, and force multiple patients as well as any accompanying care givers to wait together in a common, public area. Further, the medical procedure or appointment with a clinician may provoke anxiety in many patients.

BRIEF DESCRIPTION

In an embodiment, a modular hut includes a base, a ring rotatably coupled to the base, a seat portion coupled to an inner surface the ring, and a locking mechanism configured to lock the ring in at least a first position and a second position relative to the base.

It should be understood that the brief description above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

The present disclosure will be better understood from reading the following description of non-limiting embodiments, with reference to the attached drawings, wherein below.

DETAILED DESCRIPTION

Figure 1:
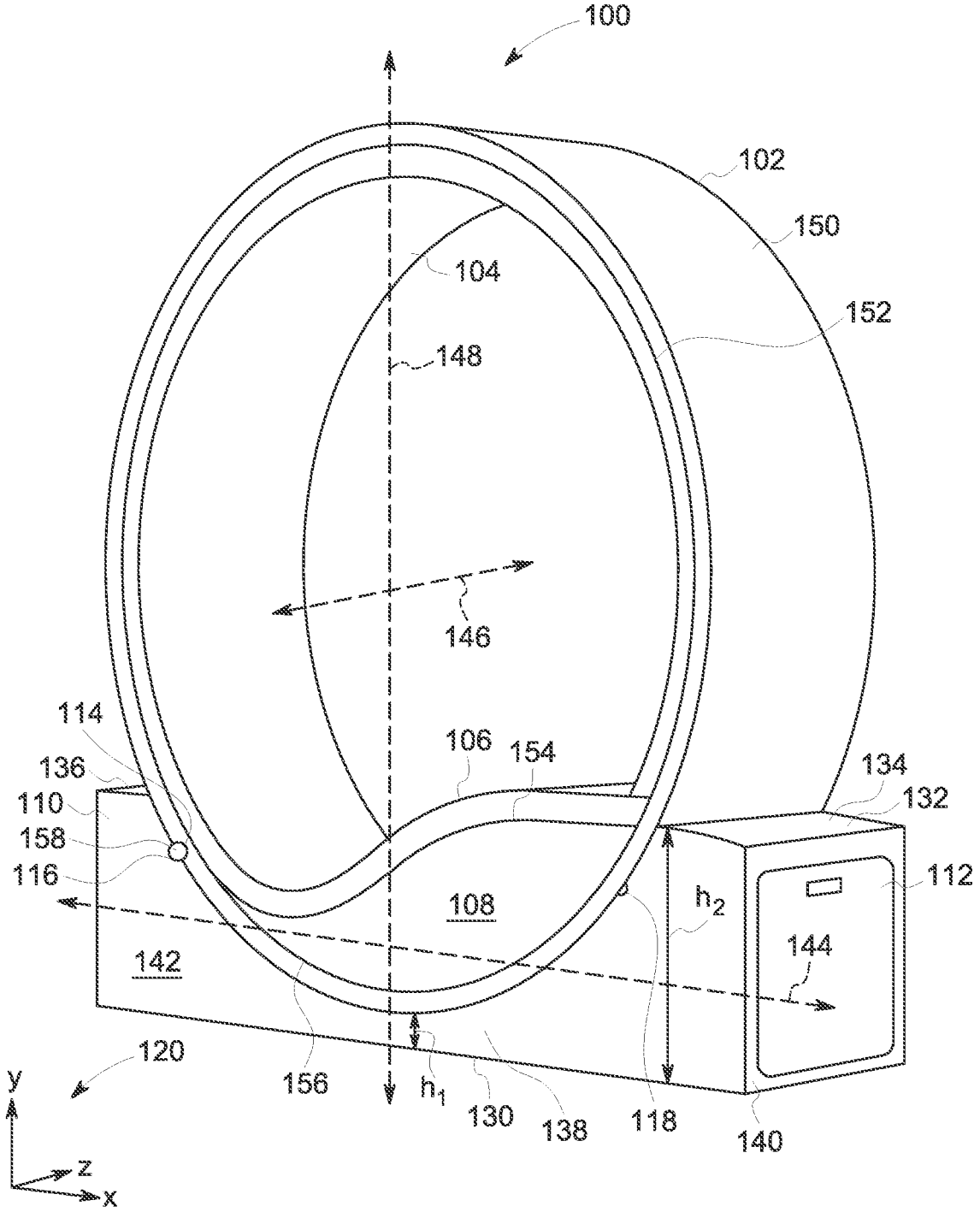
FIG. 1 is a front-right perspective view of a modular experience hut according to an embodiment of the present disclosure.

Visiting a medical facility for a medical procedure, to attend an appointment with a clinician, or for another purpose is frequently difficult or anxiety-inducing for many patients. Typically, upon arriving at the medical facility, a patient may wait for an undetermined amount of time before actually being admitted to an exam room or other location of the medical facility where the medical procedure will occur. The patient and any accompanying care givers (e.g., a parent, a spouse, or a friend) may wait in a common waiting area. These common waiting areas can be noisy, crowded, and impersonal, which may exacerbate patient anxiety prior to the medical procedure or clinician visit. In particular, it may be challenging for pediatric patients to wait patiently in a common waiting area, and extended amounts of time spent in a waiting area may increase anxiety for both the pediatric patient and accompanying care providers, such as parents. Further, if the patient has anxiety about a medical procedure, or is unsure what to expect during the medical procedure, it may be difficult for the patient to properly follow all instructions or guidelines during the procedure, which may disrupt the procedure workflow.

Thus, according to embodiments disclosed herein, a waiting area of a medical facility or other public or semi-public area may include one or more modular sub-spaces, herein referred to as modular experience huts. The experience huts described herein may provide semi-private enclosures within a larger area and are configured to provide a sense of privacy and comfort for patients or other users. The experience huts may include a ring-shaped outer wall supported by a base, with seating, a lamp, a table, and/or other modular componentry housed within the outer wall. The ring-shaped outer wall may be rotated relative to the base in order to move the seating from a bottom position for standard seating usage to a side position, where the seating is out of the way of the bottom of the outer wall, which may allow the experience hut to be used as an active experience structure rather than a sit-down space. Two or more modular experience huts may be joined together to form larger enclosures to accommodate multiple people, or allow for a tunnel-like active area. The experience huts may be positioned in a free-standing manner in a room or other space, or may be anchored against a wall. Further, the ring-shaped nature of the experience huts disclosed herein, in addition to facilitating different orientations for the seating, may also mimic the structure of some diagnostic imaging systems that are prone to invoking anxiety in patients, such as magnetic resonance imaging (MRI) bores or computed tomography (CT) bores. A patient who may have anxiety about an upcoming diagnostic imaging session, or who may be unfamiliar with being in an enclosed space such as an imaging system bore, may experience reduced anxiety during a diagnostic imaging session after having spent time in one of the experience huts disclosed herein. For example, a pediatric patient may wait and/or play in an experience hut or an adult patient may receive information about an upcoming diagnostic imaging session (e.g., how to act, what to expect).

The interaction with the bore-shaped interior of the experience hut may better prepare the patient for the upcoming diagnostic imaging session, which may reduce patient apprehension or anxiety and/or increase patient compliance with instructions during the diagnostic imaging session.

Figure 2:
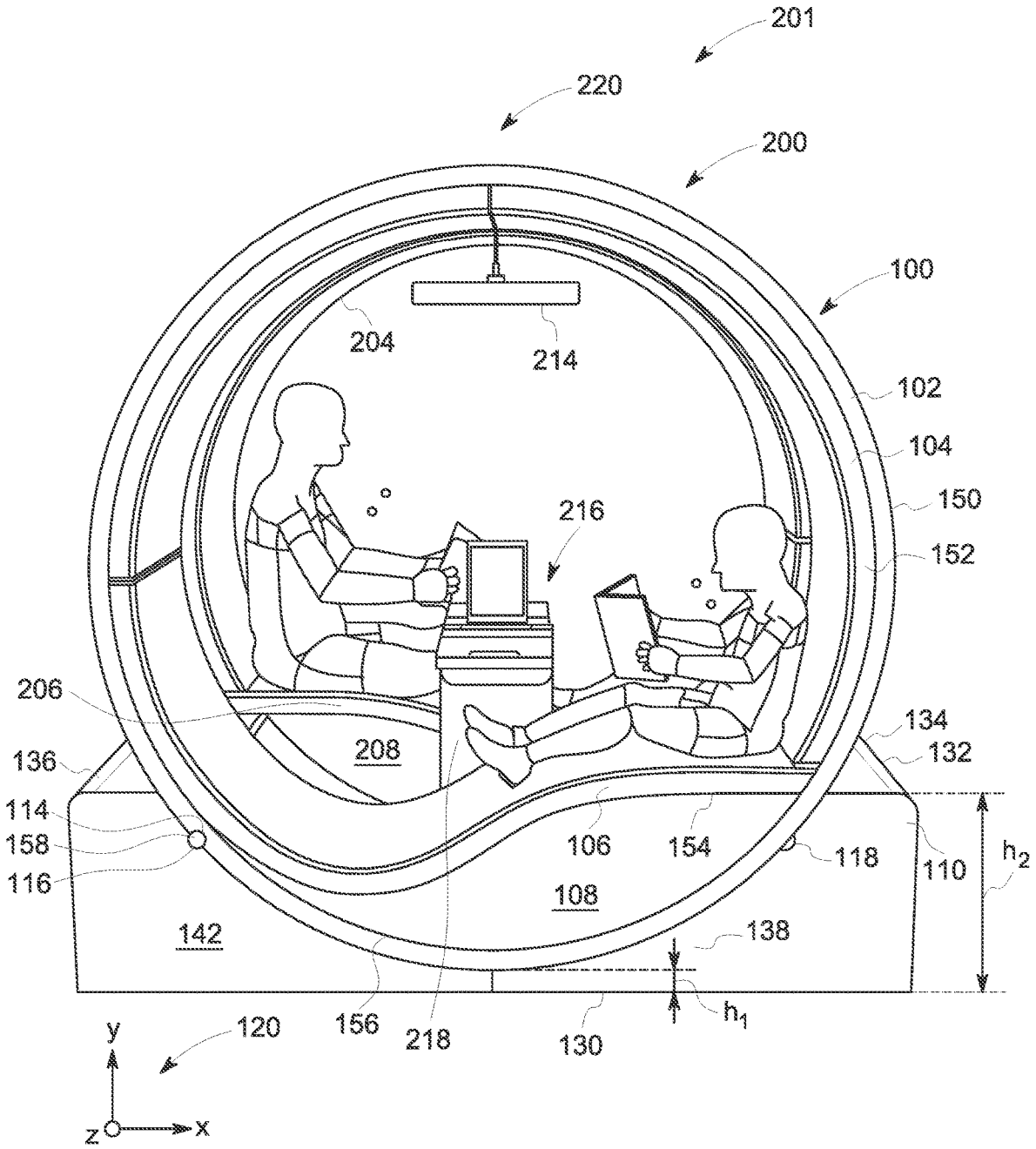
FIG. 2 is a front view of a multi-unit experience hut including the modular experience hut of FIG. 1 joined to another modular experience hut by a connection ring.
Figure 3:
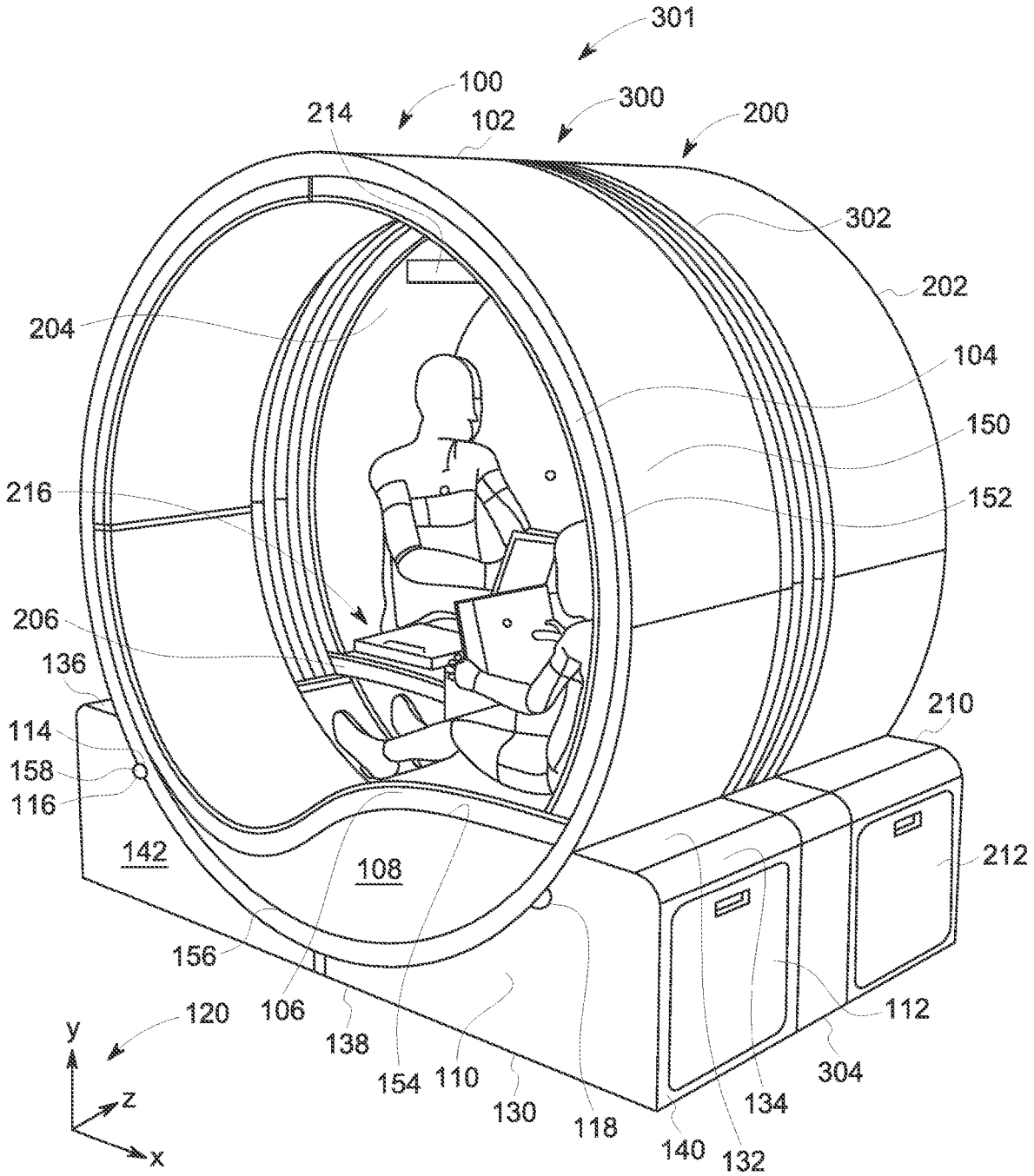
FIG. 3 is a front-right perspective view of the multi-unit experience hut of FIG. 2.
Figure 4:
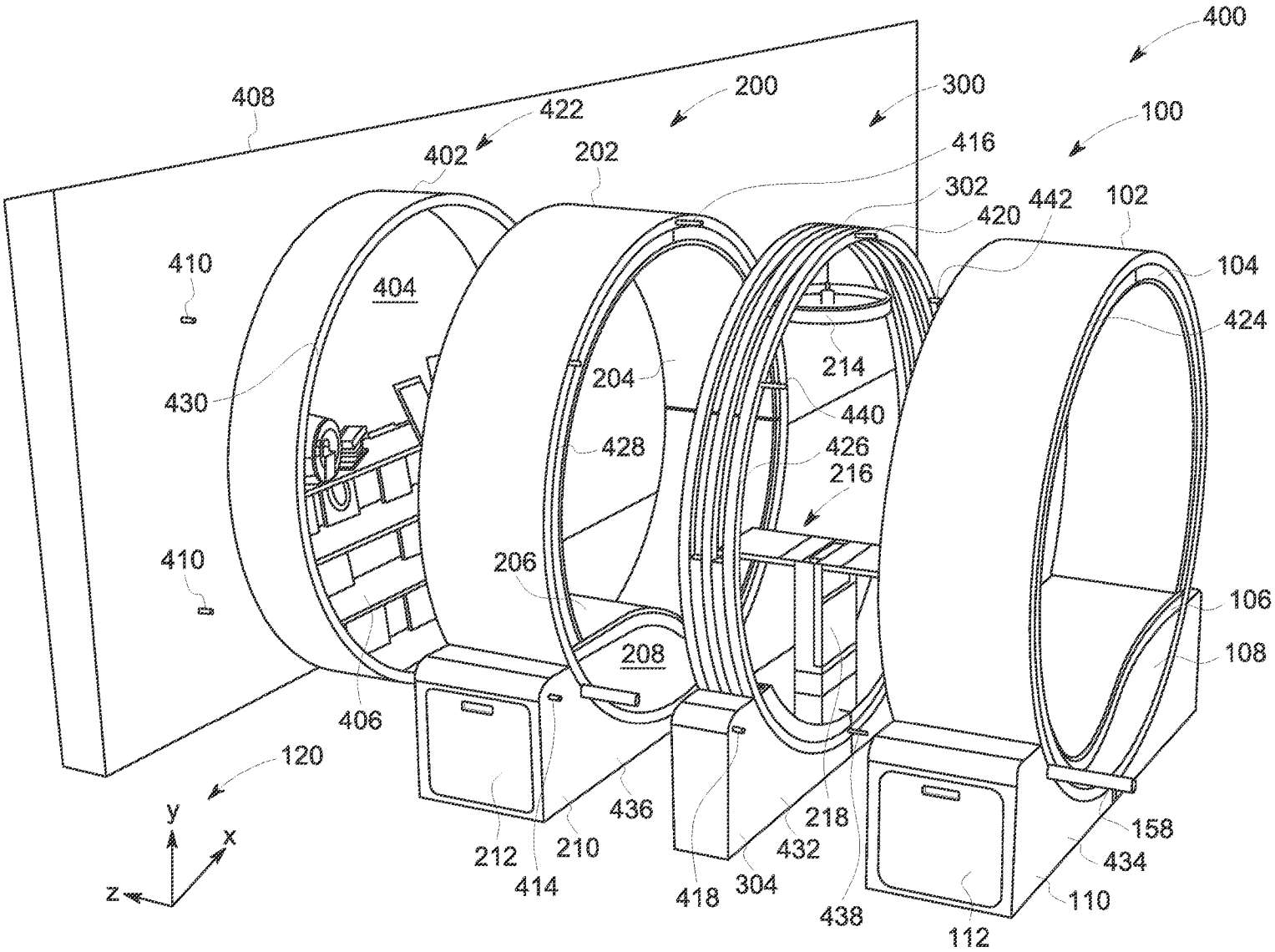
FIG. 4 shows an exploded view of the multi-unit experience hut of FIG. 2 connected to a wall.
Figure 6:
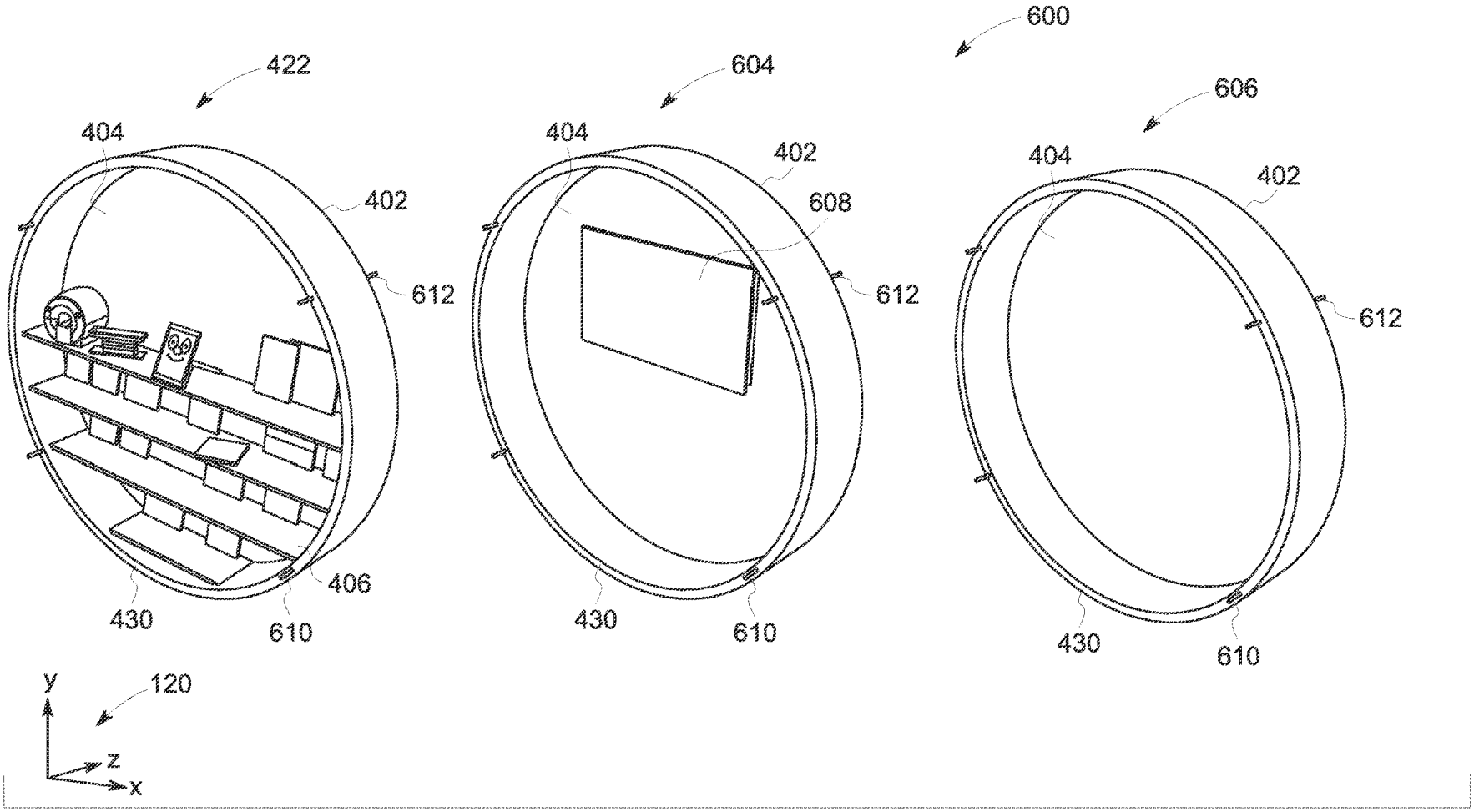
FIG. 6 illustrates different embodiments of a wall connection unit.
Figure 7:
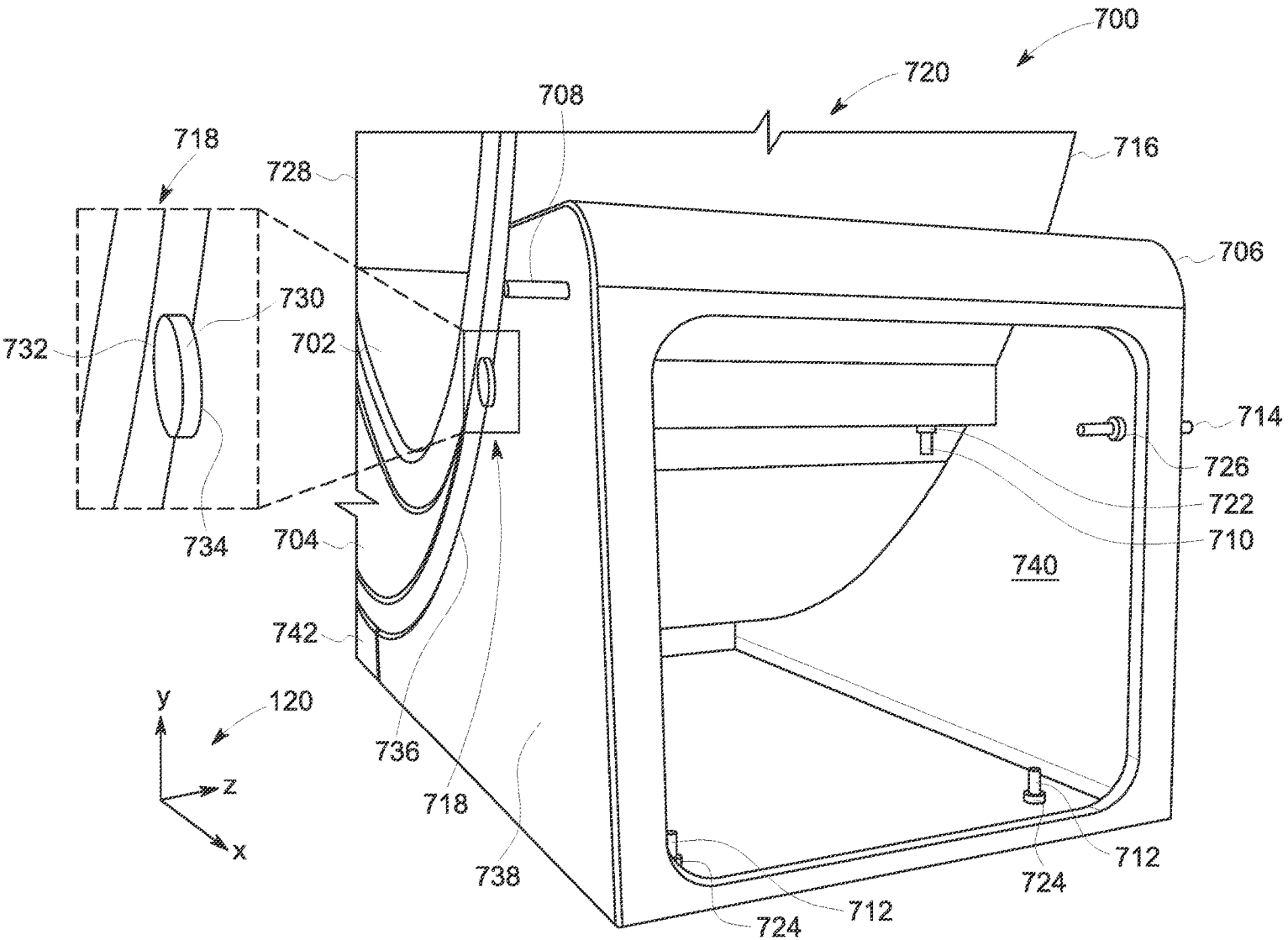
FIG. 7 is a front-right perspective view of a base of a modular experience hut.
Figure 8:
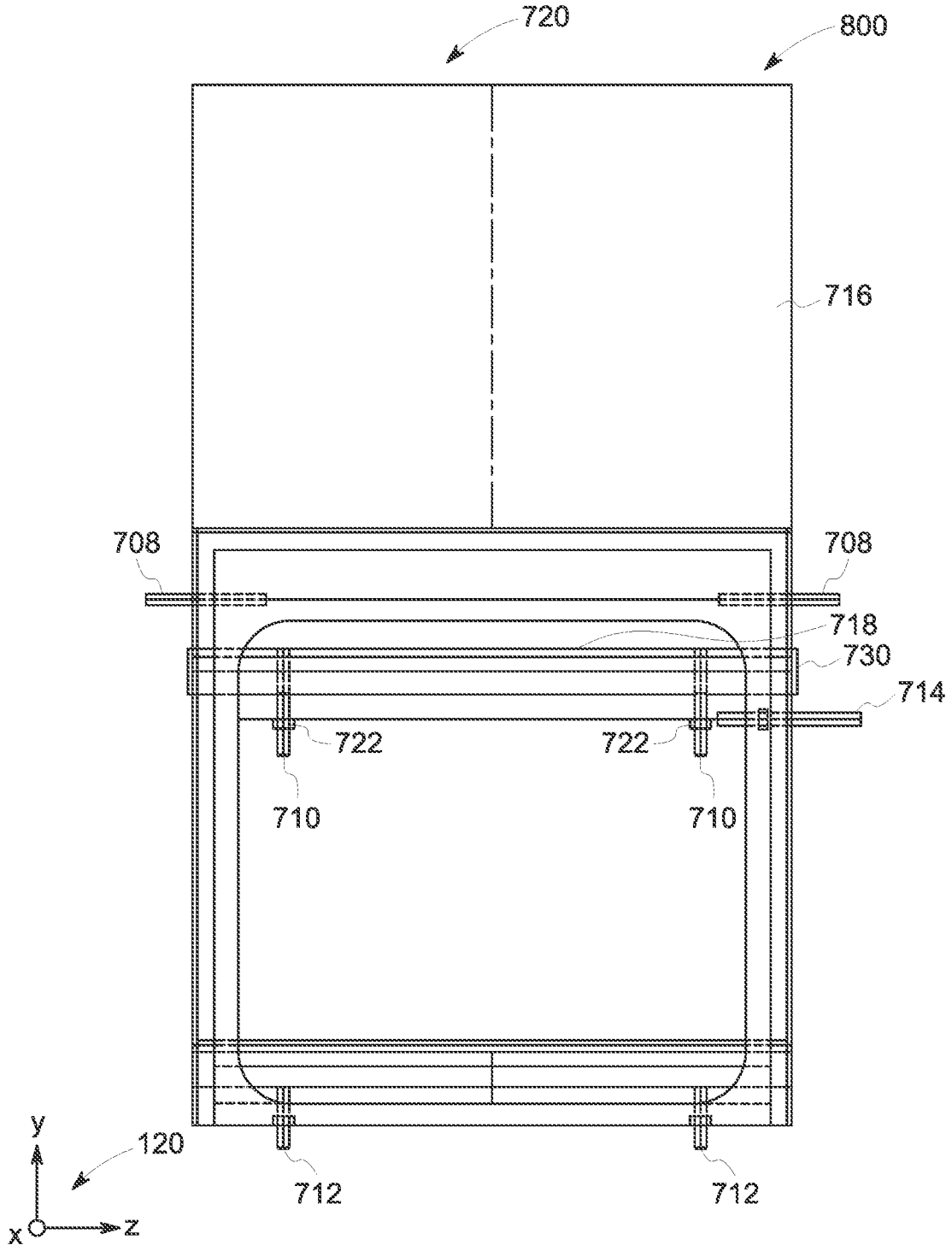
FIG. 8 is a phantom side view of the modular experience hut of FIG. 7.
Figure 9:
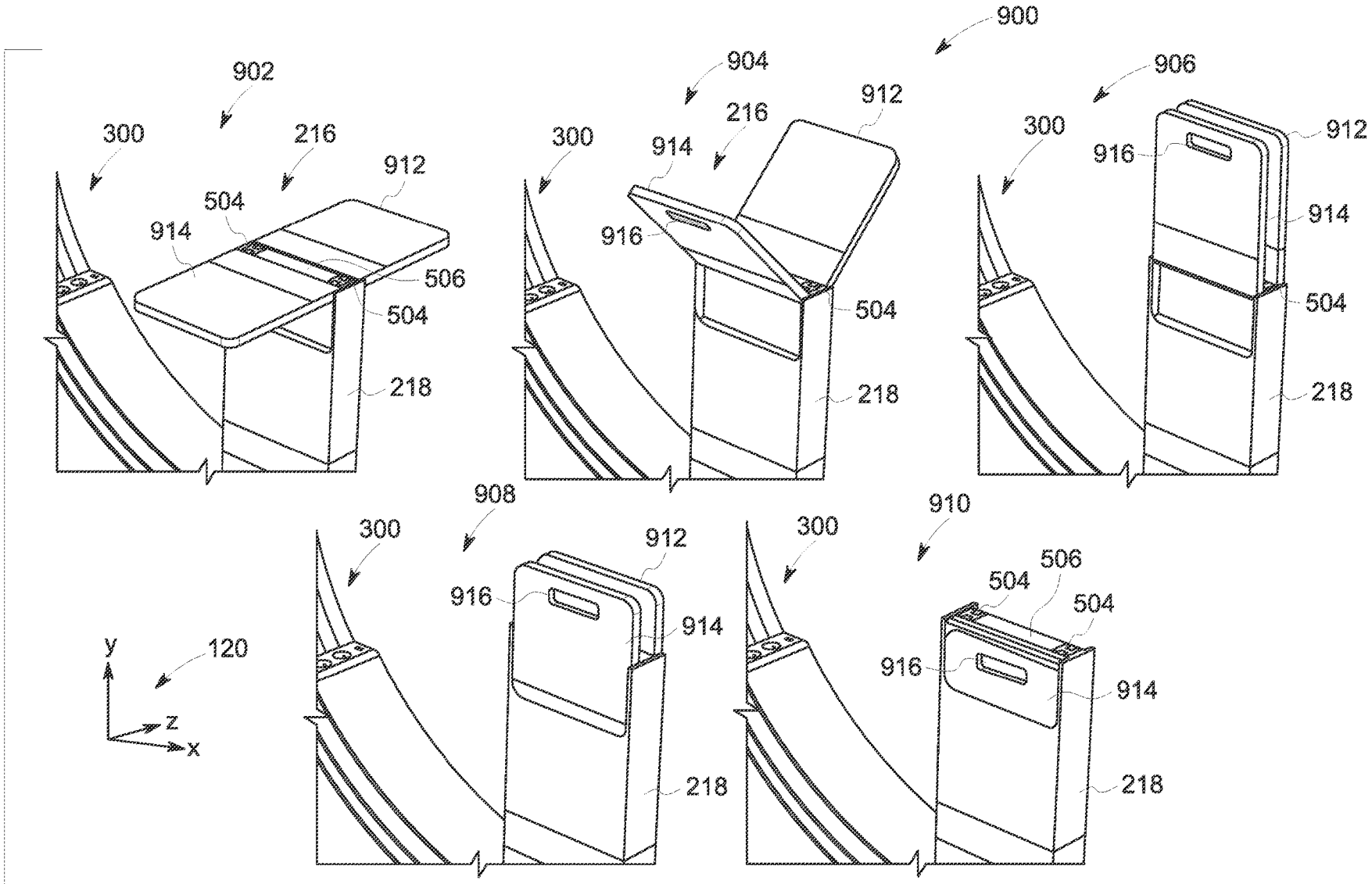
FIG. 9 is a set of views illustrating how the tabletop of the connection ring of FIG. 5 folds and retracts into the table base.
Figure 10:
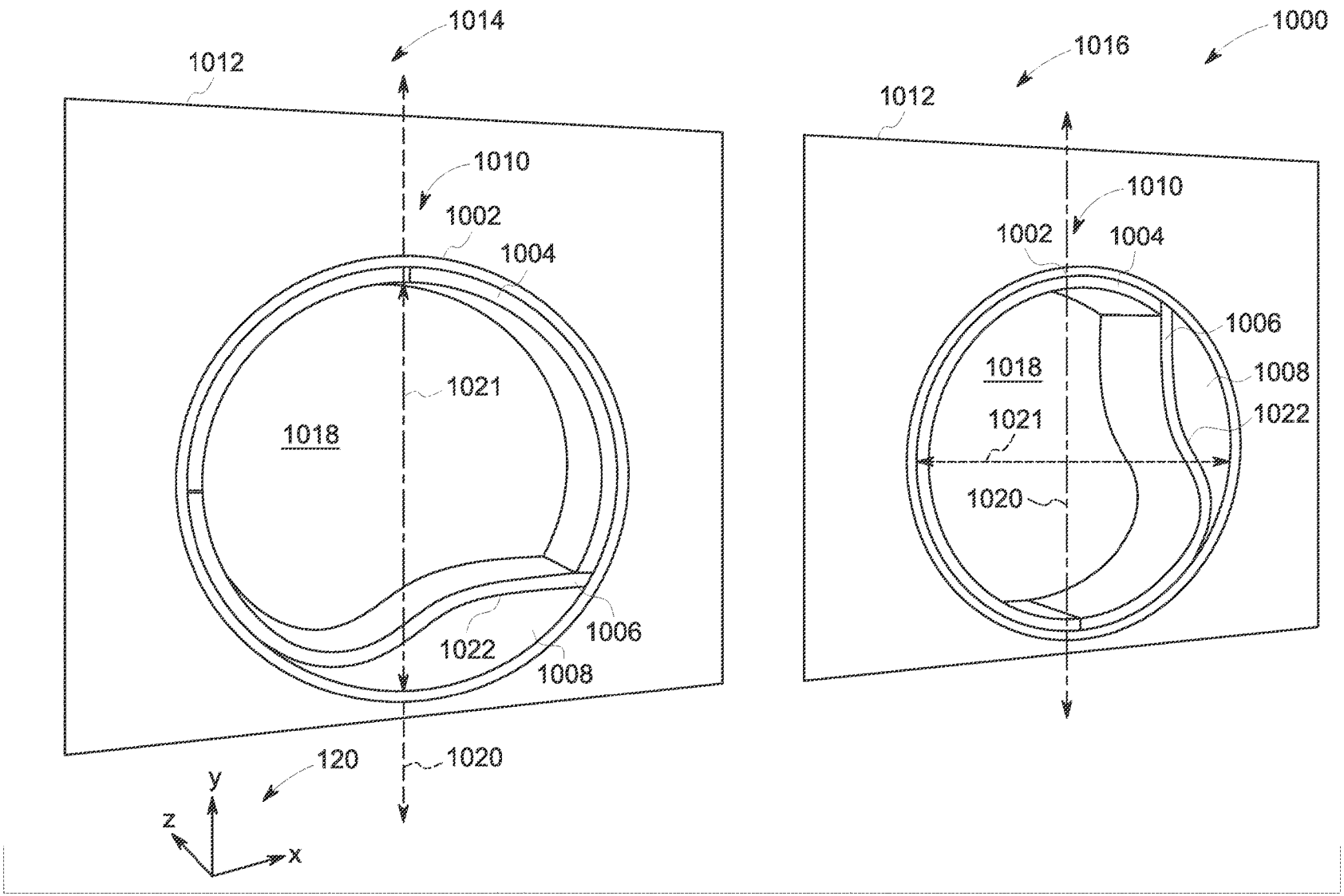
FIG. 10 shows an embodiment of a modular experience hut integrated into a wall.
Figure 11:
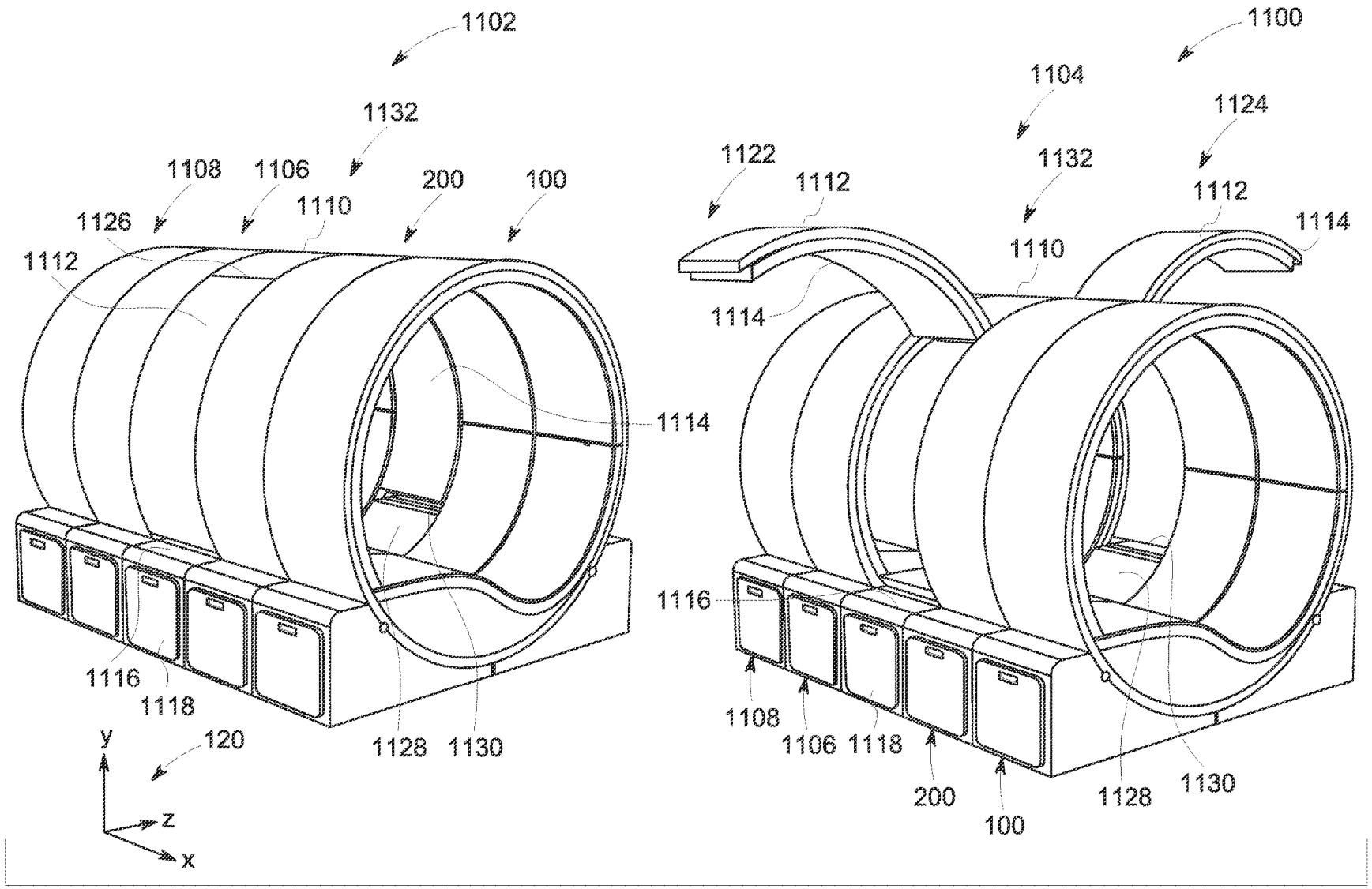
FIG. 11 is a front-right perspective view of a multi-unit experience hut with doors.
Figure 12:
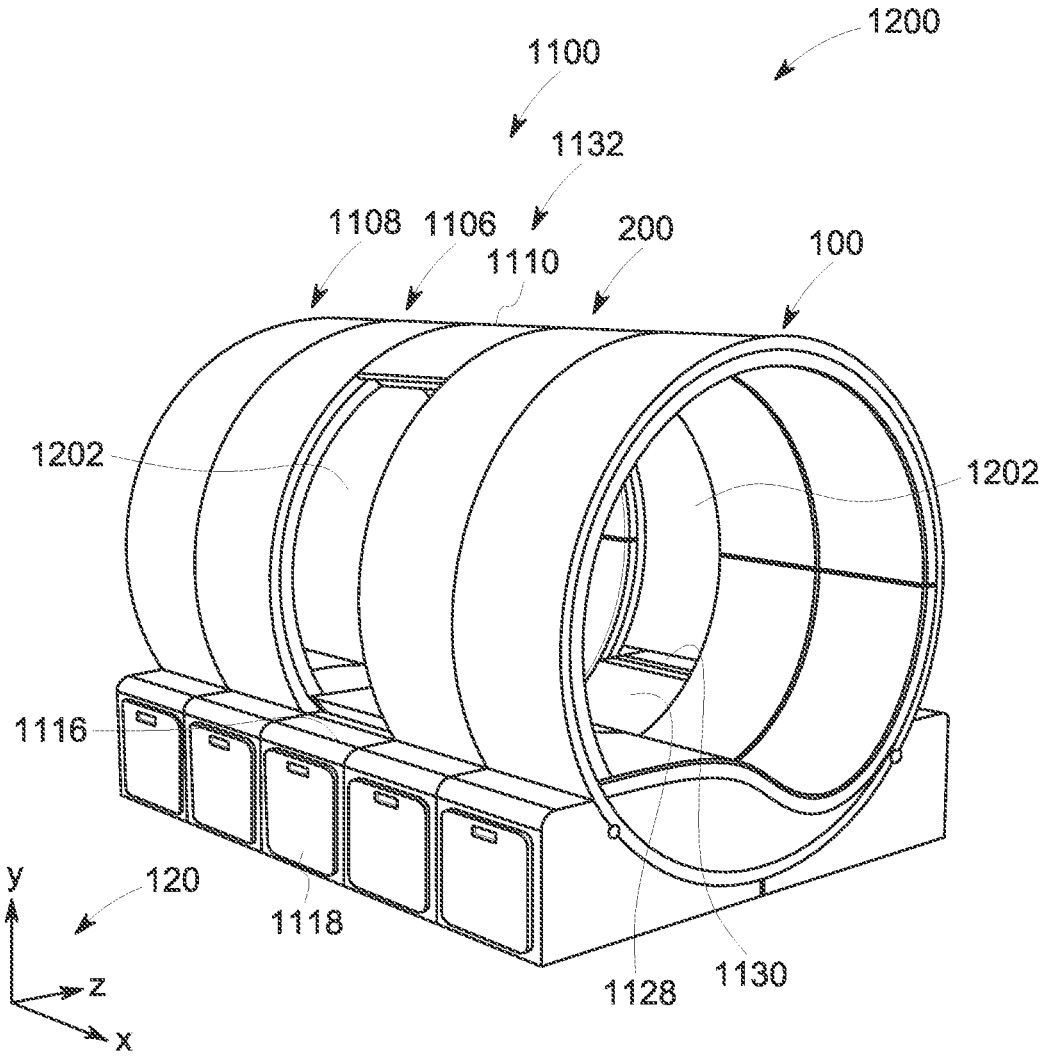
FIG. 12 is a front-right perspective view of the multi-unit experience hut of FIG. 11 with the doors removed.
Figure 13:
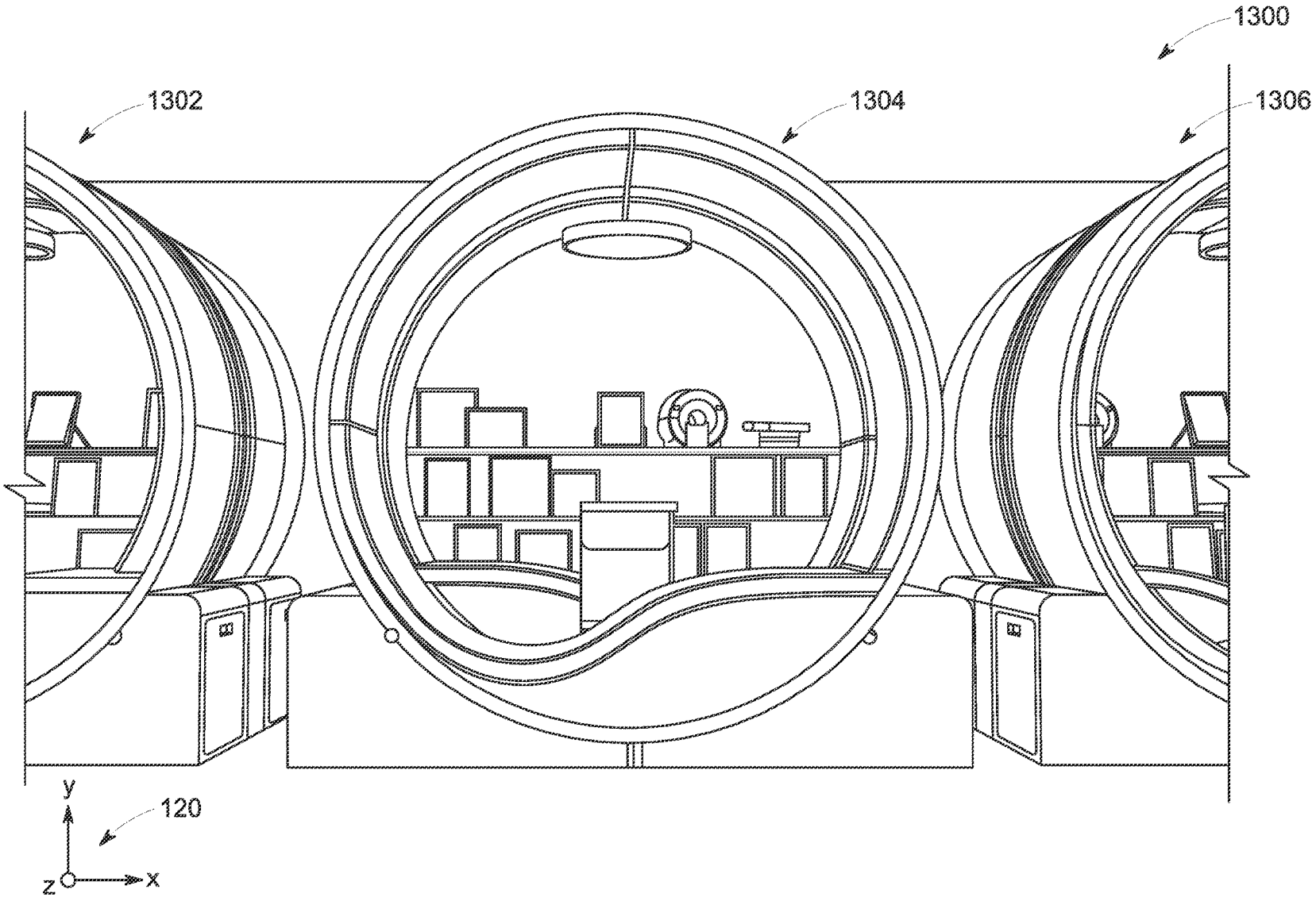
FIG. 13 shows a front view of an example arrangement of a plurality of multi-unit experience huts.
Figure 14:
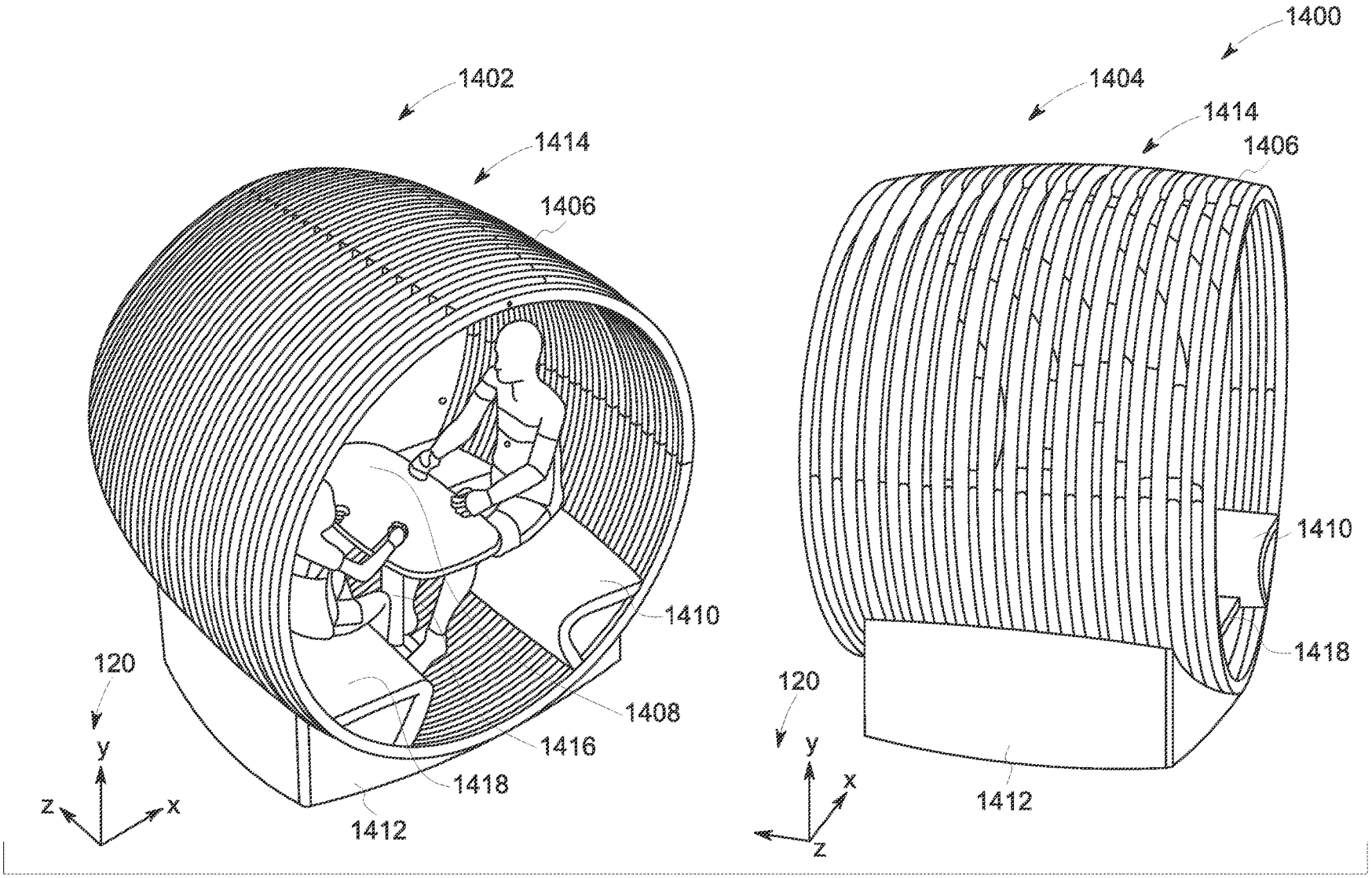
FIG. 14 shows a modular experience hut according to another embodiment of the disclosure.

FIGS. 1 and 14 show various embodiments of a single experience hut. Two or more experience huts may be joined together to form a multi-unit experience hut. FIGS. 2-4 show an example of a multi-unit experience hut comprising two experience hut units joined via a connection ring, which is shown in more detail in FIG. 5. As shown in FIG. 6, an experience hut may be coupled to a wall unit, which may allow for further enclosure of the experience hut. Each experience hut may include an outer ring supported by a base and each outer ring may be rotatable relative to the base and locked into a desired position, as shown in FIGS. 7 and 8. In some examples, a foldable table may be included in the connection ring joining two experience hut units, as shown in FIG. 9. In some embodiments, as shown in FIG. 10, an experience hut may be integrated within a wall and/or may be positioned into a first orientation or a second orientation. FIGS. 11 and 12 show a plurality of modular experience hut units, such as five units, joined together to form a tunnel-like active area. Multiple separate experience huts (whether singular unit or multi-unit huts) may be placed in a common larger area, as shown in FIG. 13.

FIGS. 1-14 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

FIG. 1 shows a modular experience hut 100 according to an embodiment of the disclosure. Modular experience hut 100 may provide one or more users, which may be children or adults, with an accessible semi-private space while waiting for a medical procedure to commence in a medical facility, for example. Modular experience hut 100 may serve as a point of transition between open and closed spaces, thereby creating fluidity within a patient workflow by serving as a connection point that allows for learning and relaxation, which may reduce visit-induced anxiety. Modular experience hut 100 may be comprised of an outer ring 102 housing an inner ring portion 104, a seating pad 106, and a contouring block 108, with outer ring 102 attached to a base 110 which accommodates rotation of outer ring 102, thereby allowing multiple seating options. A set of reference axes 120 are provided for comparison between views shown, indicating a y-axis, a z-axis, and an x-axis. In some examples, the y-axis may be parallel with a direction of gravity.

Base 110 serves as the connection point between modular experience hut 100 and the floor. Base 110 may be made out of two separate units (whether removably or permanently fixed together) or one continuous piece. Base 110 has a bottom surface 130 having a length that extends along a central longitudinal axis 144 of base 110 which is parallel to the x-axis and two side surfaces (a first side surface 140 of which is shown in FIG. 1) each having a height that extends along the y-axis and a depth that extends along the z-axis. A top surface 132 of base 110 is parallel to the bottom surface 130 along a first portion 134 and a second portion 136, but then curves with a radius of curvature that matches the radius of curvature of outer ring 102 at a third middle portion 138 that lies between the first portion 134 and second portion 136 of base 110. The curvature of third middle portion 138 of base 110 be substantially similar to the curvature of outer ring 102 so that the outer surface 150 of outer ring 102 is in face sharing contact with the middle portion of the top surface of base 110 but that outer ring 102 may rotate relative to base 110. As used herein, a value that is substantially similar to another value may include the value being within 1-5% of the other value. Base 110 has a front surface 142 and a back surface (not shown in FIG. 1) that each extend from the bottom surface 130 to the top surface 132. The first and second portions of base 110 may extend out beyond the point of contact between outer ring 102 and base 110 by a suitable distance, such as 30 cm, to accommodate a pull-out drawer 112 thereby providing an option for storage. In some embodiments, shelves may replace pull-out drawer 112 thereby providing modular experience hut 100 with an alternative storage option. In other examples, base 110 may not have storage and/or the first and second portions of base 110 may not extend beyond outer ring 102.

Base 110 includes a bottom portion under outer ring 102 having a height $h_1$. The size of base 110 may be selected according to a desired use of the hut, for example, the height $h_1$ of bottom portion under outer ring 102 may be taller or shorter than shown to position outer ring 102 at a desired height above the floor. Further, base 110 may have an overall height $h_2$. For example, in FIG. 1 base 110 has an overall height of 60 cm, a length of 2.5 m, and a width of 60 cm. In some embodiments, the height of base 110 may be increased, with the relative positioning of outer ring 102 within base 110 remaining fixed independent of base 110 height, so that outer ring 102 would be positioned higher than shown in FIG. 1, at least. In some embodiments, base 110 may be fixed to the floor in a stationary position via a suitable mechanism as further shown in FIGS. 7 and 8 (e.g., bolts, screws).

Base 110 may be symmetrical with respect to reference axis 148, which bisects the center point of base 110 and is perpendicular to central longitudinal axis 144, and contoured at third middle portion 138 so that outer ring 102 is supported in an upright vertical position as shown in the figures, in some examples. Outer ring 102 may be comprised of an outer surface 150 and an inner surface 152. Inner surface 152 of outer ring 102 may be in face sharing contact with inner ring portion 104, seating pad 106, and contouring block 108. The outer surface 150 of outer ring 102 may be in face sharing contact with base 110. Base 110 may be constructed in a manner that accommodates rotational movement of outer ring 102 along rotational axis 146 without undue gaps when outer ring 102 is manually rotated. Rotational axis 146 may be parallel to central longitudinal axis 144 and the z-axis.

Further, outer ring 102 may be locked into one or more positions via a locking mechanism (see FIGS. 7 and 8). Base 110 may house a first lock bar notch 116 and a second lock bar notch 118 that each horizontally traverse base 110 equidistant from reference axis 148. First lock bar notch 116 and second lock bar notch 118 may be located just below outer surface 150 of outer ring 102. Outer surface 150 may house a corresponding notch 114 which aligns with either first lock bar notch 116 or second lock bar notch 118 to form a port when outer ring 102 is rotated. The port formed between a lock bar notch and corresponding notch 114 allows for the insertion of a lock bar 158 into the juncture created between base 110 and outer ring 102. Once lock bar 158 has been inserted, lock bar 158 may be fixed into position as further shown in FIGS. 7 and 8. By fixing lock bar 158 into position, outer ring 102 becomes locked into a desired orientation following rotation.

Based on the position and shape of contouring block 108 within outer ring 102, modular experience hut 100 may only have two seating orientations. As shown in FIG. 1, with respect to rotation, the point on outer ring 102 where reference axis 148 bisects central longitudinal axis 144 may be a 0° reference point. Thus, a port may be formed at 315° relative to the reference point when outer ring 102 is in a first orientation (e.g., where the port is formed by lock bar notch 116 and corresponding notch 114) and a port may be formed at 45° relative to the reference point when outer ring 102 is in a second orientation (e.g., where the port is formed by lock bar notch 118 and corresponding notch 114). In FIG. 1, a port has been created at 315° between corresponding notch 114 and first lock bar notch 116 so that lock bar 158 could be inserted locking outer ring 102 into a first orientation. When the outer ring 102 is in the first orientation, a user may use inner ring portion 104 for back support while contouring block 108 provides seating support (as shown in FIG. 2) and/or a user may use seating pad 106 for back support while contouring block 108 elevates the user's legs thereby allowing the user to lay in a resting position. As shown in FIG. 1, lock bar 158 may be removed and outer ring 102 rotated 90° so that a port is formed between second lock bar notch 118 and corresponding notch 114, and outer ring 102 may be locked into a second orientation using lock bar 158. In the second orientation (as shown in FIG. 10), contouring block 108 may provide back support to an individual using modular experience hut 100 and/or users may not interact with contouring block 108 while seated, using only inner ring portion 104 and seating pad 106 for direct support (as shown in FIG. 10). Outer ring 102 may have a limited angle of rotation which may be 45° in either direction from the 0° reference point as defined by reference axis 148 so that corresponding notch 114 may only rotate up to and between lock bar notches within base 110. In other examples, outer ring 102 may freely rotate 360° or have a larger/smaller angle of rotation.

In some embodiments, modular experience hut 100 may have more seating orientations. For example, outer ring 102 may house more than one corresponding notch so that outer ring 102 may be locked in more than two orientations. A second corresponding notch may be included in outer surface 150 in an antipodal orientation to corresponding notch 114 thereby creating options for a third and fourth orientation in which the seating area is solely comprised of inner ring portion 104. In some embodiments, additional corresponding notches may be incorporated into outer surface 150 at different locations and the size/shape of contouring block 108, inner ring portion 104, and/or seating pad 106 may be suitably adjusted to accommodate additional orientations. Outer ring 102 may house corresponding notches at designated intervals all along outer surface 150 so a seating orientation is formed whenever a corresponding notch is in alignment with either first lock bar notch 116 or second lock bar notch 118. The desired seating orientation may then be locked into place as described above and further described with respect to FIGS. 7 and 8.

Outer ring 102 may be made of a smooth, hard, durable and easy to clean solid surface material (e.g., wood with a protective coating, high density polyethylene) that may allow it to withstand degradation with use. In some embodiments, the surface of outer ring 102 may be contoured or have openings that allow visible access to the interior of modular experience hut 100 when an individual is facing outer ring 102, such as shown in FIG. 14.

Outer ring 102 may be of a suitable size to comfortably accommodate users spanning a range of heights (e.g., heights ranging from a tall adult to a short child). In one non-limiting example, outer ring 102 may have a diameter of 2 m and width (e.g., along the z axis) of 30 cm so users can easily enter modular experience hut 100 and use the seating area without feeling encumbered. The width of outer ring 102 may be equal or substantially equal to that of base 110 so that the outer edges of outer ring 102 are flushly aligned with the side surfaces of base 110 along the y-axis thereby allowing modular experience hut 100 to be connected to other modular experience hut units as described with respect to FIGS. 4, 7, and 8. In other examples, outer ring 102 may be of other suitable dimensions to allow individuals to beneficially utilize modular experience hut 100 regardless of height. Alternatively, the dimensions of outer ring 102 may be customized for a particular group of patients (e.g., a pediatric facility may install modular experience huts sized specifically for children).

Outer ring 102 may house seating pad 106 and contouring block 108 which together comprise a seat portion where an individual may rest or sit. Outer ring 102 may also house inner ring portion 104, portions of which may also comprise the seat portion. Inner ring portion 104 may provide back support to an individual sitting on seating pad 106 dependent on outer ring 102 orientation. For example, back support may be provided by inner ring portion 104 when outer ring 102 is in a first orientation (e.g., the orientation shown in FIG. 1) whereas back support may be provided by seating pad 106 when outer ring 102 is in a second orientation (e.g., an orientation shown in FIG. 10).

Inner ring portion 104 and seating pad 106 may be constructed of waterproof, commercial grade solid surface padding to accommodate high traffic and intensive use environments like that of a medical facility (such as in medical waiting rooms). Inner ring portion 104 and seating pad 106 may be made of the same material. Alternatively, seating pad 106 may be made out of a different material than inner ring portion 104 that provides the user with more cushion or support when sitting. In some embodiments, the surfaces of inner ring portion 104 and seating pad 106 may have different textures that enhance the user experience.

Definition and support for seating pad 106 is provided by contouring block 108 to which seating pad 106 is attached. Seating pad 106 may be affixed to contouring block 108 by permanent means (e.g., screws, industrial staples) or semi-permanent means (e.g., hook-and-loop fasteners, zip fasteners). Contouring block 108 is attached to outer ring 102. As shown in FIG. 1, at least, a bottom surface 156 of contouring block 108 curves with a radius of curvature that matches the radius of curvature of outer ring 102 whereas a top surface 154 of contouring block 108 is contoured into an asymmetrical s-shape. The asymmetrical s-shape of contouring block 108 allows for seating options within modular experience hut 100 when outer ring 102 is rotated to a first orientation or a second orientation as shown in FIGS. 2-4, 10, and 13. In some embodiments, contouring block 108 may be contoured into a symmetrical s-shape. In further examples, contouring block 108 may be of another suitable ergonomic shape which may provide more options for seating orientations with outer ring 102 rotation. Contouring block 108 may be comprised of the same material as outer ring 102 or seating pad 106 or may be comprised of another suitable material. In some embodiments, contouring block 108 may be integrated with outer ring 102 such that no seams or coupling mechanisms are present between contouring block 108 and outer ring 102. In other embodiments, contouring block 108 may be separate from outer ring 102 and fastened to outer ring 102 via a suitable mechanism, such as adhesive, screws, or the like. When contouring block 108 is separate from outer ring 102, contouring block 108 may be removably coupled to outer ring 102 in some examples.

Modular experience hut 100 may be connected to additional modular experience huts as shown in FIG. 2 thereby creating a semi-private multi-person space in which patients may speak and interact with family, friends, or healthcare professionals. FIG. 2 shows a front view 201 of modular experience hut 100 coupled to a second experience hut 200 thereby creating a multi-unit hut 220 and an intimate space for more than one person. Second experience hut 200 is a non-limiting example of modular experience hut 100 described with respect to FIG. 1 and thus includes a base 210 supporting a rotatable circular outer ring 202 that houses an inner ring portion 204, seating pad 206, and contouring block 208 as well as a mechanism for locking outer ring 202 into position (e.g., a first orientation or a second orientation, as explained above with respect to FIG. 1). Second experience hut 200 may be coupled to modular experience hut 100 by a connection ring 300 (shown in FIG. 3). Connection ring 300 is described in further detail with respect to FIGS. 3 and 5. In some embodiments, second experience hut 200 may be directly coupled to modular experience hut 100 as shown in FIGS. 11 and 12. Second experience hut 200 may be coupled to modular experience hut 100 with outer ring 202 locked into a position so that the seating area, comprised of seating pad 206 and contouring block 208, is in the opposite orientation to that of modular experience hut 100 thus individuals within the modular unit are facing each other as shown in FIGS. 2 and 3. The opposite orientation may be defined as an outer ring and seating area of a second modular experience hut being flipped horizontally relative to a first hut, so that while the seating area is located at the bottom of the ring/next the base similar to the first hut, the curvature of the seating area of the second hut is opposite that the first seating area. Alternatively, the seating pads and contouring blocks may be in the same orientation so that individuals within the modular unit are facing the same direction. For example, second experience hut 200 may be directly coupled to modular experience hut 100 with the seating area of each hut set in the same orientation so that the combined seating area creates a bench for users (e.g., FIGS. 11 and 12).

Figure 5:
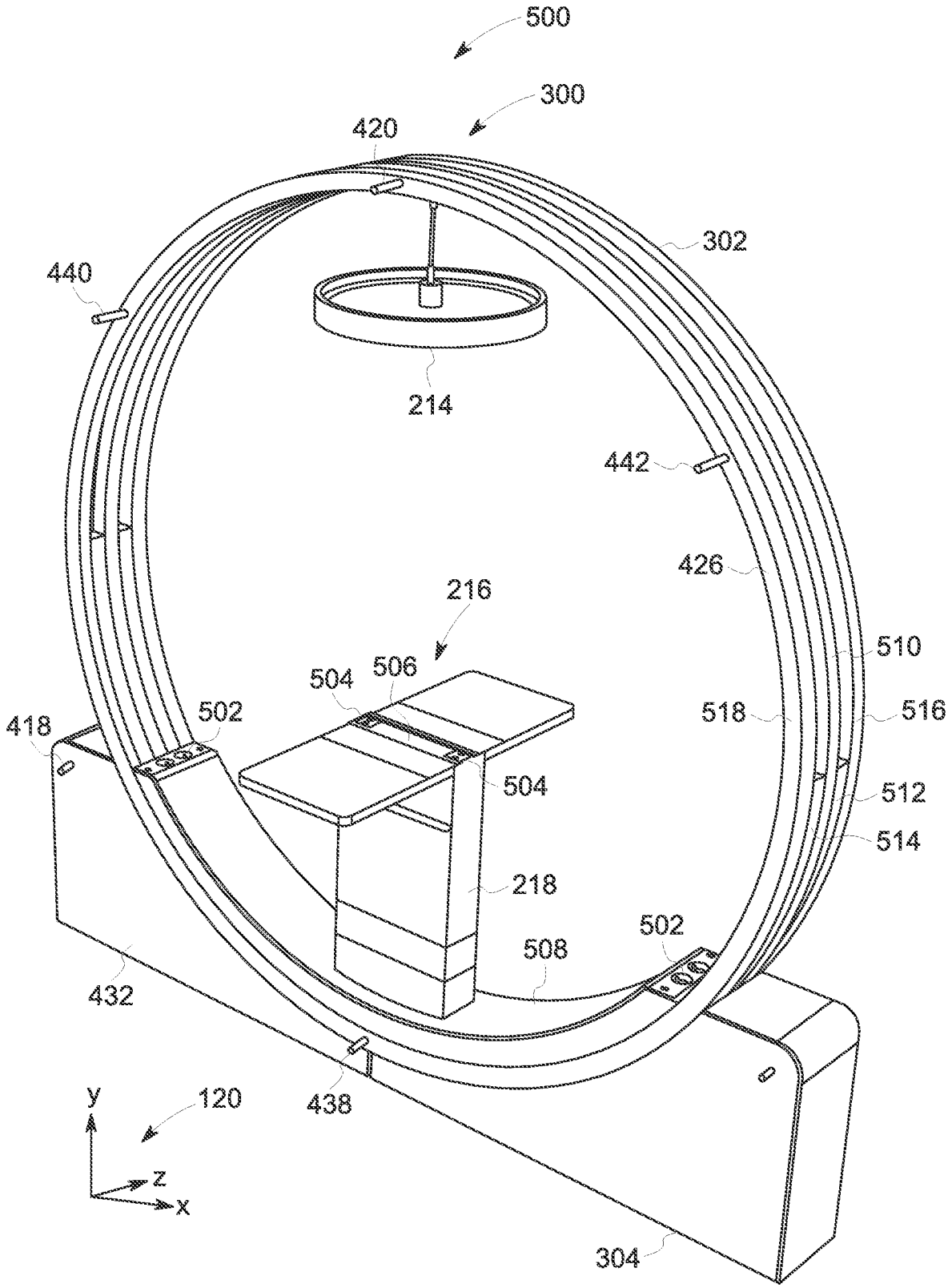
FIG. 5 is a front-right perspective view of a connection ring.

Connection ring 300 may house a lighting element 214, as further shown in FIGS. 4, 5, and 9, at least. Lighting element 214 may be a lamp directly connected to the top inner surface of ring 302 of connection ring 300 (as shown in FIGS. 4-5, at least) thereby providing simultaneous lighting to modular experience hut 100 and second experience hut 200. In some embodiments, connection ring 300 may house two or multiple adjustable lighting elements 214 allowing for differential or individual lighting control for each attached experience hut. In some embodiments, lighting element 214 may be attached at a different location on ring 302 that may increase ease of access for children using the modular hut, such as at a lower point on the inner surface of ring 302. In addition to lighting element 214, connection ring 300 may house a tabletop 216 connected to a table base 218 attached to the bottom inner surface of ring 302. Tabletop 216 provides individual users of modular experience hut 100 and second experience hut 200 with a multi-use surface on which they may play games (e.g., puzzles, board games, cards), draw, fill out paperwork, hold various forms of media (e.g., a laptop, a tablet), and so on. Tabletop 216 may fold and retract into table base 218 as described with respect to FIG. 9.

FIG. 3 shows a front-right perspective view 301 of multi-unit hut 220 including modular experience hut 100 coupled to second experience hut 200 by connection ring 300. Connection ring 300 is comprised of a base 304 supporting a circular ring 302 that may house tabletop 216 and table base 218. A detailed view of connection ring 300 uncoupled from the modular experience huts is provided in FIG. 5. As shown in the figures, in some examples, circular ring 302 may have openings that may act as vents for air flow in modular experience huts. Modular experience hut 100 and second experience hut 200 may be coupled to each other or connection ring 300 using an attachment mechanism as described with respect to FIG. 4.

FIG. 4 shows an exploded view 400 of multi-unit hut 220. Exploded view 400 illustrates an example arrangement of how a multi-unit experience hut may be composed to provide users with a stable semi-private environment with extra shelving. Modular experience hut 100 may be attached to connection ring 300 using an attachment mechanism having removable protruding fasteners and complementary apertures. For example, base 304 of connection ring 300 may have two protruding fasteners inserted in first base connection surface 432 that fit into complementary apertures on a second base connection surface (not shown in FIG. 4, opposite to a first base connection surface 434) of base 110 of modular experience hut 100. A first fastener 418 of connection ring 300 may be located near and protrude from the top edge of connection surface 432 of base 304, whereas a second fastener (not shown in FIG. 4) may be located at the same relative location as first fastener 418 but on the opposite side with respect to the median point of connection surface 432 along the y-axis. The first connection surface 426 of ring 302 may also have four removable protruding fasteners inserted that fit in complementary apertures on a second connection surface (not shown in FIG. 4, opposite to a first connection surface 424) of outer ring 102 of modular experience hut 100. A first fastener 420 may be located at the median point of the top edge of first connection surface 426 of ring 302 with respect to the y-axis and be considered as a 0° reference point. A second fastener 440 on ring 302 may be located at 315° with respect to first fastener 420 and a third fastener 442 located at 45° with respect to first fastener 420. A fourth fastener 438 may be located in direct alignment with first fastener 420 with respect to the y-axis but at the bottom of first connection surface 426 of ring 302 as shown in FIGS. 4 and 5. When modular experience hut 100 is aligned with connection ring 300 so that the protruding fasteners of connection ring 300 are aligned with complementary apertures on modular experience hut 100, the two units can be pushed together until all protruding fasteners have been flushly inserted into complementary apertures thereby creating a stable multi-unit hut. In this same manner, protruding fasteners 414 on first base connection surface 436 of base 210 and protruding fasteners 416 on a first connection surface 428 of outer ring 202 of second experience hut 200 may be aligned with complementary apertures on a second connection surface (not shown in FIG. 4, opposite to first connection surface 426) and a second base connection surface (not shown in FIG. 4, opposite to first base connection surface 432) of connection ring 300 and the three units pushed together creating a larger, stable multi-unit experience hut.

To further increase stability, multi-unit hut 220 may be attached to a wall 408 by a wall connection unit 422. Wall connection unit 422 may be comprised of a ring 402 that houses a back panel 404 to which shelves 406 may be attached. Wall connection unit 422 and some embodiments of a wall connection unit are further described with respect to FIG. 6. In the same manner as described above, wall connection unit 422 may be attached to wall 408 by pushing apertures on a second connection surface (not shown in FIG. 4, opposite to a first connection surface 430) located on the back of ring 402 onto complementary protruding fasteners 410 that have been connected to wall 408. Once wall connection unit 422 has been attached to wall 408, ring 402 may have front protruding fasteners on first connection surface 430 that align with complementary apertures within a second connection surface (not shown in FIG. 4, opposite to first connection surface 428) of outer ring 202 of second experience hut 200. Thus, in the same manner as described above, the multi-unit experience hut (comprised of second experience hut 200, connection ring 300, and modular experience hut 100) may be stably attached to wall connection unit 422 by pushing the two units together until all protruding fasteners have been flushly inserted into complementary apertures.

FIG. 5 is a detailed view 500 of connection ring 300 as presented in FIGS. 2-4. As previously described with respect to FIGS. 2 and 3, connection ring 300 may be comprised of base 304 supporting circular ring 302 housing lighting element 214, tabletop 216, and table base 218. As shown in the figures, in some examples, circular ring 302 may be comprised of a first circular ring 510 disposed between a first half ring 514 and a second half ring 514. First half ring 514 is disposed between first circular ring 510 and a second circular ring 518. Second half ring 512 is disposed between first circular ring 510 and a third circular ring 516. The inclusion of half rings within ring 302 creates open spaces that may act as vents for air flow or serve as windows allowing users to see outside multi-unit hut 220 from a face-forward seated position. In some embodiments, ring 302 may be comprised of one ring without any open spaces thereby increasing privacy within modular multi-hut units. In other examples, ring 302 may be comprised of one ring that has a window that can be set in an open or closed position thereby allowing the user to determine the degree of privacy within a modular multi-hut unit.

Table base 218 may be a rectangular extension protruding from a semi-circular support 508 that connects to and fits flushly within ring 302. The bottom surface of semi-circular support 508 curves with a radius of curvature that matches the radius of curvature of ring 302 to which semi-circular support 508 is directly connected. The top upward facing edges of semi-circular support 508 may be in alignment with the height of base 304. Table base 218 may house hinge element 506 to which tabletop 216 is directly attached allowing tabletop 216 to be folded upward and subsequently recessed into table base 218 as further described with respect to FIGS. 7 and 8. The rectangular extension of table base 218 may be of sufficient height to accommodate use of tabletop 216 when connection ring 300 is connected to a modular experience hut. For example, as shown in FIG. 2, an individual sitting in modular experience hut 100 may easily access tabletop 216 without impeding leg movement. In some embodiments, the height of table base 218 may be variable and defined by the user.

Table base 218 may house a power source that feeds into AC outlets 502 and/or USB outlets 504 that can be used by patients, staff, or family for various entertainment purposes, charging needs, to plug in monitoring devices, etc. The power source in table base 218 may also provide electricity to lighting element 214, with wiring fed from table base 218 through first circular ring 510 to which lighting element 214 is connected. In some examples, a cable connected to lighting element 214 may be wired through first circular ring 510 and exit base 304 with a plug configured to be inserted into a power outlet of the room/facility in which the hut is installed. Alternatively, lighting element 214 may be battery or solar powered and therefore not hard-wired to connection ring 300. In some embodiments, wiring in circular ring 302 may connect to other devices that may enhance the user experience in addition to or as an alternative to lighting element 214 such as a fan or an aromatherapy diffuser.

The top upward facing edges of the semi-circular support 508 of table base 218 may house AC outlets 502 so that the outlets are easily accessible by individuals utilizing a multi-unit experience hut in a seated position, regardless of seating orientation. Similarly, USB outlets 504 may be embedded in hinge element 506 of table base 218 thereby providing easy access to charging when individuals are using tabletop 216 or when tabletop 216 is stored within table base 218 as described with respect to FIG. 9. The AC outlets 502, USB outlets 504, and/or lighting element 214 may be provided with power from a power source that may include a cable terminating in a connector configured to be inserted into a wall or floor power outlet of the space where the huts are located.

In some embodiments, a power source may be housed within base 304 that feeds into outlets 502 on connection ring 300 and table base 218 may be removable from semi-circular support 508, thereby the user is provided with functioning outlets and additional options for spatial arrangement within a multi-unit experience but joined by connection ring(s) 300. In other examples, a multi-unit experience hut may include modular experience hut units directly connected to one another without an intermediary connection ring 300. In these cases, the multi-unit experience hut may be directly attached to the wall, such as described in FIG. 4, by wall connection unit 422 and power provided to the multi-unit directly from a wall outlet.

FIG. 6 shows different embodiments 600 of a wall connection unit that allows modular experience huts to be directly connected to a wall (as shown in FIGS. 4 and 13) which may increase structural stability of the hut/huts and provide the hut/huts with access to electricity wired into the building. Alternatively, the wall connection unit may form a back wall for a hut even without coupling the connection unit to a wall thereby enhancing privacy while providing more options for where the hut may be located within a room or facility. Further, a wall connection unit may be used to couple two separate modular experience huts together thereby forming a barrier in between the two huts which may allow unrelated patients to use the two separate modular experience huts without their privacy being compromised. As described with respect to FIG. 4, a wall connection unit, for example wall connection 422, may be comprised of ring 402 that houses back panel 404 to which shelves 406 may be attached. As previously described with respect to FIG. 4, wall connection unit 422 may be attached to a wall by a mechanism including protruding fasteners and complementary apertures. In the same manner as described above, wall connection unit 422 may be attached to a wall by pushing protruding fasteners 612 located on the back edge of ring 402 into complementary apertures on the wall. Once wall connection unit 422 has been securely attached to the wall, ring 402 may have front protruding fasteners 610 that align with complementary apertures on a modular experience hut so that the two units may be pushed together until all protruding fasteners have been flushly inserted into complementary apertures thereby creating a stable multi-unit.

Ring 402 may be comprised of any suitable material (e.g., wood with a protective coating, high density polyethylene) to provide stability to the hut/huts attached to the wall by connection ring 422. Ring 402 may be comprised of a solid surface thereby increasing privacy within connected modular experience huts. In some embodiments, ring 402 may have slats that allow ambient air and light into modular experience huts connected to a wall by connection ring 422 thereby enhancing the user experience. Ring 402 houses and is connected to back panel 404 to which shelves 406 may be attached to display comfort items, informational brochures, provide extra storage, and so on. A second wall connection unit embodiment 604 may not include shelves and may have a flat screen 608 embedded within and wired through back panel 404 so flat screen 608 is powered by a wall outlet. Flat screen 608 may be used for educational and/or entertainment purposes. A third wall connection unit embodiment 606 may not include shelves or a flat screen connected to back panel 404. Back panel 404 may be custom designed or colored to enhance the patient experience (e.g., back panel 404 may display a soothing color, the patient's favorite color, artwork, calming scenes). In some embodiments, back panel 404 may be custom-fitted with lighting or interactive elements that may enhance the user experience. In addition, or as an alternative, to attaching a hut or huts to the wall for increased stability, modular experience huts may be directly connected to the floor and/or wall as illustrated in FIGS. 7 and 8.

FIG. 7 shows a close-up view 700 of the internal components within a base 706 of a modular experience hut 720 that allow users to define a desired seating orientation and attach the hut to the floor for increased stability during use. FIG. 8 shows a phantom side view 800 of modular experience hut 720. FIGS. 7 and 8 will be described collectively. Modular experience hut 720 is a non-limiting example of modular experience hut 100 described with respect to FIG. 1 and thus includes base 706 supporting a rotatable circular outer ring 716 that houses an inner ring portion 728, seating pad 702, and contouring block 704 as well as a locking mechanism 718 to lock outer ring 716 into position. Modular experience hut 720 may also have a pull-drawer in base 706 that has been removed so that the internal components within base 706 are visible within close-up view 700. As described with respect to FIG. 1, base 706 may be comprised of a first portion (not shown in FIG. 7), a second portion 738, and third middle portion 742 that lies between a first portion and second portion 738. The top surface of third middle portion 742 may be partially open (e.g., the top surface of third middle portion 742 may not extend fully across the width of base 706) whereas the top surface of second portion 738 may be closed and extend from a front surface 738 to a back surface (not shown in FIG. 7, opposite to front surface 738). In some embodiments, third middle portion 742 of base 706 may have a top surface that extends from front surface 738 to a back surface with a radius of curvature that matches (e.g., is substantially similar to) outer ring 716 thereby accommodating rotation of outer ring 716.

As previously described with respect to FIG. 4, base 706 of modular experience hut 720 may also have protruding fasteners 708 that allow modular experience hut 720 to be connected to other modular experience hut units or a connection ring, such as connection ring 300. Additionally, base 706 may house a mechanism for connecting modular experience hut 720 directly to a wall and/or the floor to increase structural stability. Base 706 may have an aperture in a side panel 740 such that when modular experience hut 720 is parallel and flush to the wall, the wall is visible through the side panel aperture. Once modular experience hut 720 is parallel and flush to the wall, a blind set screw 714 may be inserted through the aperture in side panel 740, be screwed into the wall, and locked into place by tightening a locking nut 726 onto blind set screw 714 thereby connecting modular experience hut 720 to the wall. Similarly, base 706 may have apertures in the bottom panel that allow a blind set screw 712 to be inserted, screwed into the floor, and locked into place with a locking nut 724 thereby connecting modular experience hut 720 to the floor. In some embodiments, base 706 may house retractable feet and/or wheels that contribute to modular experience hut 720 stability when set in position and ease of transportation, respectively. In still further examples, when base 706 includes wheels, the wheels may be attached via locking swivel plate casters that allow modular experience hut 720 to be freely moved by manually pushing modular experience hut 720. Once modular experience hut 720 is in a desired location and orientation, the wheels may be locked so that modular experience hut 720 is stably fixed in position.

As previously described with respect to FIG. 1, to change the seating orientation of modular experience hut 720, outer ring 716 may be manually rotated until a port is formed by aligning a corresponding notch 732 in the outer surface 736 of outer ring 716 with a lock bar notch 734 within base 706. The port formed between corresponding notch 732 and lock bar notch 734 allows for the insertion of lock bar 730 into the juncture between base 706 and outer ring 716. Base 706 may have two blind set screws 710 that vertically traverse the side of the port located in base 706 that lock bar 730 is inserted into, as further shown in FIG. 8. Once lock bar 730 has been inserted, lock bar 730 may be fixed into position by manually tightening each blind set screw 710 until it comes into physical contact with lock bar 730. Once each blind set screw 710 is in contact with lock bar 730, a locking nut 722 on blind set screw 710 may be manually turned until flush with the surface of base 706 that forms the bottom half of the port lock bar 730 is inserted within thereby fixing lock bar 730 into position. Once lock bar 730 is fixed into position, outer ring 716 will no longer freely rotate thereby making the seating area of modular experience hut 720 stable for use. To change the seating orientation, each locking nut 722 may be manually loosed thereby allowing each blind set screw 710 to be manually loosened until neither blind set screw 710 is in contact with lock bar 730. Once lock bar 730 is no longer in contact with either blind set screw 710, lock bar 730 may be removed and outer ring 716 manually rotated into a new desired seating orientation. The new seating orientation may then be fixed into place as described above.

FIG. 9 illustrates a set of views 900 of a tabletop housed within a connection ring folding and retracting into a table base thereby providing users with more options for space within a multi-unit experience hut containing a connection ring. As described with respect to FIG. 3, connection ring 300 is comprised of base 304 supporting circular ring 302 that may house tabletop 216 and table base 218. Tabletop 216 may be comprised of two panels, a first panel 912 and a second panel 914, each connected to hinge element 506. In a first view 902, tabletop 216 is shown in a fully extended position in which tabletop 216 is perpendicular to table base 218, thereby providing the users of adjacent modular experience huts with a level surface area for various activities (e.g., writing, games). From the fully extended position, first panel 914 and second panel 912 may be manually folded upward using a recessed handle 916 as shown in a second view 904. Recessed handle 916 may be located on the underside of each table panel. As shown in second view 904, at least, recessed handle 916 may run parallel to table base 218 along the underside edge not connected to hinge element 506 of first panel 914 and second panel 912. Recessed handle 916 may be of a rounded rectangular shape and of a suitable depth thereby allowing users to easily grip first panel 914 and second panel 912 by inserting the tips of their fingers into the recessed space of recession handle 916.

Once a user has gripped recession handle 916, first panel 914 and/or second panel 912 may be manually lifted along a folding path defined by hinge element 506 that brings both table panels into parallel alignment with table base 218 as shown in a third view 906. First panel 914 and second panel 912 may move up and down within a set range once in parallel alignment with table base 218 (e.g., along the y-axis) as defined by a sliding mechanism, coupled to hinge element 506, housed within table base 218. Once first panel 914 and second panel 912 of tabletop 216 are in parallel alignment with table base 218, the table panels may be manually recessed into table base 218 by gripping recessed handle 916 and pulling or pushing downward. In a fourth view 908, first panel 914 and second panel 912 are shown partially recessed into table base 218. In fourth view 908, an individual may use recessed handle 916 to pull first panel 914 and/or second panel 912 upward and outward along the folding path defined by hinge element 506 into a fully extended position as shown in first view 902. Alternatively, an individual may use recessed handle 916 to pull first panel 914 and second panel 912 downward into a fully stored position within table base 218 as shown in a fifth view 910.

As shown in fifth view 910, first panel 914 and second panel 912 may be recessed into table base 218 such that recessed handle 916 is still accessible to the user of an adjoining modular experience hut when first panel 914 and second panel 912 are in a fully stored position thereby allowing the user to easily move a table panel back into a fully extended position when desired. First panel 914 and second panel 912 may be extended and recessed independent of each other thereby allowing multiple options for a usable surface area within a multi-unit experience hut containing a connection ring. For example, the users of modular experience hut 100 and second modular experience hut 200 of the multi-unit experience hut shown FIG. 2 may recess the table panels of tabletop 216 independently so that a first table panel may be fully extended for use while reading and a second table panel is in a fully stored position while a user sleeps. As shown in set of views 900, USB outlets 504 embedded in hinge element 506 may be accessible independent of the folding and retracting configurations of tabletop 216 so that differences in tabletop storage preferences amongst users do not impede other users' ability to plug devices into USB outlets 504.

FIG. 10 shows set of views 1000 of a modular experience hut 1010 integrated into a wall 1012 which may provide patients with a semi-private space within facilities where space may be limited. As a non-limiting example, modular experience hut 1010 may be comprised of an outer ring 1002, housing an inner ring portion 1004, seating pad 1006, and contouring block 1008, as previously described in FIG. 1, as well as a back panel 1018. Modular experience hut 1010 may be flushly integrated into wall 1012 in a first orientation 1014 or a second orientation 1016. In the first orientation 1014, a reference axis 1020 that is parallel to a direction of gravity (e.g., parallel with the y-axis) may be aligned with a center diameter 1021 of the outer ring 1002. The point where reference axis 1020 bisects outer ring 1002 may be a 0° reference point. Thus, in first orientation 1014, outer ring 1002 may be at 0°. In the in second orientation 1016, outer ring 1002 may be positioned at 90° with respect to the reference point of reference axis 1020, as shown by the center diameter 1021 being perpendicular to reference axis 1020.

In first orientation 1014, a user may sit on seating pad 1006 and use back panel 1018 for back support while his/her thighs are perpendicular to back panel 1018 and thus his/her feet may rest on the floor. In second orientation 1016, a user may sit on the part of seating pad 1006 that is not directly connected to contouring block 1008 or a portion of inner ring portion 1004 and use back panel 1018 for back support as described above. In first orientation 1014, users may sit within modular experience hut 1010, with their body parallel to wall 1012 and back against seating pad 1006 and legs slightly elevated as their feet point toward inner ring portion 1004. Alternatively, in first orientation 1014, individuals may sit within modular experience hut 1010, with their body parallel to wall 1012 and back against inner ring portion 1004 so that their legs follow the dropping curve of the asymmetrical s-shape of top surface 1022 of contouring block 1008 and thus their feet are positioned lower than their torso.

In second orientation 1016, users may also sit within modular experience hut 1010, with their body parallel to wall 1012 and back against seating pad 1006 which is supported by contouring block 1008. Thus, dependent on user height (e.g., an adult or a child), the asymmetrical s-shape of top surface 1022 of contouring block 1008 may provide ergonomic spinal support to users. Children or shorter adults sitting in modular experience hut 1010 as just described may have their back supported solely by seating pad 1006 while their head may be supported by seating pad 1006 in combination with contouring block 1008. Alternatively, in second orientation 1016, a user may sit within modular experience hut 1010, with their body parallel to wall 1012 and their back supported by inner ring portion 1004. In this way, the ability to move the outer ring and associated contouring block and seating pad into different orientations may provide different seating options for different users, which may increase user comfort particularly when users of different sizes interact with the modular experience hut. Further, in the second orientation shown in FIG. 10, a user may be able to stand within the modular experience hut or otherwise interact with the modular experience hut in a more active manner.

Modular experience hut 1010 may house rotational and locking mechanisms that allow modular experience hut 1010 to be rotated within wall 1012 and locked into either first orientation 1014 or second orientation 1016 thereby allowing the user two seating options, as explained above with respect to FIG. 1. In some embodiments, handles may be integrated into outer ring 1002 so an individual may manually turn modular experience hut 1010 into first orientation 1014 or second orientation 1016 and a locking mechanism, similar to that described with respect to FIGS. 1, 7, and 8, employed thereby fixing the desired orientation in place.

FIG. 11 shows an example of a multi-unit experience hut 1100 comprising a plurality of directly connected experience huts, with one of the huts (fifth experience hut 1132) including doors 1122 and 1124. In FIG. 11, a first view 1102 shows the doors 1122 and 1124 closed while a second view 1104 shows doors 1122 and 1124 opened. FIG. 12 shows a view 1200 of the multi-unit experience hut of FIG. 11 with the doors removed. FIGS. 11 and 12 will be described collectively. Multi-unit experience hut 1100 includes experience hut 100, experience hut 200, third experience hut 1106, fourth experience hut 1108, and fifth experience hut 1132. Third experience hut 1106 and fourth experience hut 1108 are non-limiting examples of modular experience hut 100 described with respect to FIG. 1 and thus each include a base supporting a rotatable circular outer ring that houses an inner ring portion, seating pad, and contouring block. Similarly, as shown in first view 1102, fifth experience hut 1132 may have a base 1116 with a pull-out drawer 118 that houses a contouring block to which a seating pad 1128 is attached as previously described (FIG. 1). Base 1116 may support a ring that matches the exact dimensions and positioning of outer ring 102 of modular experience hut 100 comprised of three adjoining components: a first door 1122 connected to a door connection element 1110 to which a second door 1124 is connected.

First door 1122 and second door 1124 may each be attached to door connection element 1110 by a lift-off hinge 1126. Lift-off hinge 1126 allows first door 1122 and second door 1124 to swing along a defined path. Lift-off hinge 1126 also allows first door 1122 and second door 1124 to be removed from or attached to fifth experience hut 1132 as desired. If first door 1122 and/or second door 1124 is removed from fifth experience hut 1132, connection element 1110 remains in fixed position based on a system of protruding fasteners and complementary apertures as described with respect to FIG. 4. Each door of fifth experience hut 1132 may have an outer surface 1112 and an inner surface 1114. Outer surface 1112 may extend several inches beyond inner surface 1114 so that first door 1122 and second door 1124 may fit firmly against door landing 1130 thereby allowing the door to be in a closed position as shown in first view 1102. Lift-off hinges 1126 allow first door 1122 and second door 1124 to swing upward toward the ceiling, thereby making an open doorway through which individuals may exit multi-unit experience hut 1100. First door 1122 and second door 1124 may go from a closed position, as shown in first view 1102, to an open position, as shown in second view 1104, by manually pushing inner surface 1114 up toward the ceiling in alignment with the swinging path established by lift-off hinge 1126. Alternatively, a handle may be attached to outer surface 1112 of first door 1122 and second door 1124 that will allow users to manually lift the doors to an open position. Similarly, first door 1122 and second door 1124 may be closed by manually pushing on outer surface 1112 until inner surface 1114 comes firmly into contact with door landing 1130. Alternatively, first door 1122 and second door 1124 may each be removed from fifth experience hut 1132 as shown in FIG. 12 thereby creating a fixed opening 1202 through which individuals may enter or exit multi-unit experience hut 1100. In other examples, fifth experience hut 1132 may be located in a different relative location. The rings within multi-unit experience hut 1100 are all in the same orientation but may be rotated with relative respect to the orientation shown in FIG. 11 to different orientations.

The multi-unit experience hut 1100 of FIGS. 11 and 12 shows five huts but any number of huts is possible in other examples. For example, a multi-unit experience hut may be comprised of modular experience hut 100 connected to fifth experience hut 1132 which is attached to second experience hut 200, with second experience hut 200 connected to a wall via wall connection unit 422 thereby allowing users of second experience hut 200 to exit the multi-unit experience hut using first door 1122 and/or second door 1124 of fifth experience hut 1132. In some embodiments, multi-unit experience hut 1100 may have more than five huts and include multiple sets of doors.

FIG. 13 shows a front view 1300 of an example space with an arrangement of multi-unit experience huts. A first multi-unit experience hut 1302, a second multi-unit experience hut 1304, and a third multi-unit experience hut 1306 are non-limiting examples of the multi-unit experience huts described in FIGS. 2 and 3 and thus may each include a first experience hut coupled to a second experience hut by a connection ring. First multi-unit experience hut 1302, second multi-unit experience hut 1304, and third multi-unit experience hut 1306 may also each include a wall connection unit, as described with respect to FIGS. 4 and 6 that anchors each multi-unit to the wall. The arrangement of multi-unit experience huts in view 1300 allows for the creation of three semi-private spaces within an otherwise public area in which patients and friends, family, and/or staff may relax, play games, converse, and so on before medical procedures. In other examples, first multi-unit experience hut 1302, second multi-unit experience hut 1304, and third multi-unit experience hut 1306 may be freely arranged throughout the available floor space without being directly connected to a wall. In other example spaces, first multi-unit experience hut 1302 and second multi-unit experience hut 1304 may each be replaced by modular experience huts integrated into the wall thereby freeing up floor space while still providing three semi-private spaces for patients.

FIG. 14 shows two views 1400 of a modular experience hut 1414 according to another embodiment of the disclosure. As a non-limiting example shown in first view 1402 and second view 1404, hut 1414 may be comprised of a base 1412 supporting a ring 1406 made of slats that interlock at the top of ring 1406. As compared to outer ring 102 of modular experience hut 100 described in FIG. 1, the openings within ring 1406 of modular experience hut 1414 allow users to see outside the hut in all directions. Thus, modular experience hut 1414 may provide a reasonable alternative to modular experience hut 100 for patients who want a semi-private space that might also have issues with confined or limited spaces. In some embodiments, ring 1406 may be a solid ring made of a suitable transparent material thereby enhancing privacy while still providing visual access to the rest of the room.

Base 1412 may not include storage or may have a storage built-in in the form of a pull-out drawer, similar to modular experience hut 100 as previously described (FIG. 1), or shelves. Ring 1406 may be connected to base 1412 in a fixed position and house a table (comprised of a tabletop 1408 and a table base 1416) as well as a first bench 1418 and a second bench 1410. Thus, modular experience hut 1414 does not require a connection ring for users to access a table as compared to modular experience hut 100. In other examples, tabletop 1408 may fold and retract into table base 1416 (similar to that described for connection ring 300 in FIG. 9) thereby providing options for space within modular experience hut 1414. Alternatively, modular experience hut 1414 may not have a table.

First bench 1418 and second bench 1410 may be directly connected to ring 1406 and/or base 1412 so that the seating positions within modular experience hut 1414 are fixed, as compared to modular experience hut 100 which offers multiple seating orientations based on outer ring 102 rotation. First bench 1418 and second bench 1410 may be positioned within modular experience hut 1414 so that ring 1406 serves as the back support for users of either bench, as shown in view 1402. Alternatively, modular experience hut 1414 may include four separate seats rather than two benches. In other examples, modular experience hut 1414 may only have first bench 1418 and a flat screen may be incorporated where ring 1406 currently provides back support for users of second bench 1410. The flat screen may be hard-wired into the slats of ring 1406 and electricity provided by a power source housed in base 1412 thereby providing a means for entertainment or education to users of modular experience hut 1414.

Modular experience hut 1414 may be coupled to a wall and/or to the floor which may enhance structural stability. Alternatively, wheels may be attached via locking swivel plate casters to the bottom surface of base 1412 so that modular experience hut 1414 may be easily transported via manual pushing and stably locked into position at a desired location. Further, modular experience hut 1414 may be smaller to accommodate fewer people (e.g., base 1412, ring 1406, first bench 1418, and second bench 1410 may be half the length as that shown in FIG. 14). In other examples, modular experience hut 1414 may be larger than shown in FIG. 14 to accommodate more individuals. In some embodiments, modular experience hut 1414 may include lighting and/or power so that individuals within the hut may read, utilize various electronic devices for entertainment, educational, or calming purposes, and so on.

The experience huts described above were described as being configured to be installed within a medical facility but the experience huts described herein may be used in other environments without departing from the scope of this disclosure. For example, modular experience huts may be installed within libraries or student union buildings to provide semi-private study areas. In another example, modular experience huts may be installed after security checkpoints in airports to provide spaces for passengers to take naps, work, reduce flight related anxiety, or entertain themselves, while experience huts installed before security checkpoints may provide semi-private spaces for family and friends to wait for arrivals.

As used herein, an element or step recited in the singular and proceeded with the word "a" or "an" should be understood as not excluding plural of said elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property. The terms "including" and "in which" are used as the plain-language equivalents of the respective terms "comprising" and "wherein." Moreover, the terms "first," "second," and "third," etc. are used merely as labels, and are not intended to impose numerical requirements or a particular positional order on their objects.

This written description uses examples to disclose the invention, including the best mode, and also to enable a person of ordinary skill in the relevant art to practice the invention, including making and using any devices or systems and performing any incorporated methods. The patentable scope of the invention is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal languages of the claims.

The invention claimed is:

1. A modular hut, comprising:

a base;

a ring rotatably coupled to the base and including a plurality of attachment mechanisms distributed along a circumference of the ring, the plurality of attachment mechanisms configured to secure a connection ring, another modular hut, or a wall in direct contact with a first side surface of the ring;

a seat portion coupled to an inner surface the ring; and a locking mechanism configured to lock the ring in at least a first position and a second position relative to the base.

2. The modular hut of claim 1, wherein the ring has a first radius of curvature and a top surface of the base includes a curved portion having a second radius of curvature that matches the first radius of curvature.

3. The modular hut of claim 2, wherein when the locking mechanism is in an unlocked state, the ring is configured to rotate relative to the base about an axis of rotation of the ring.

4. The modular hut of claim 2, wherein the seat portion has a curved top surface and a curved bottom surface, the curved top surface being curved to form an asymmetric s-shape and the curved bottom surface having a third radius curvature that matches the first radius of curvature.

5. The modular hut of claim 3, wherein when the locking mechanism is a first locked state, the ring is held in the first position, the first position including a reference point of the ring being at zero degrees relative to a reference axis of the base, the reference axis of the base bisecting a center point of the base and extending perpendicular to the axis of rotation and perpendicular to a longitudinal axis of the base.

6. The modular hut of claim 5, wherein when the locking mechanism is a second locked state, the ring is held in the second position, the second position including the reference point of the ring being at 90 degrees relative to the reference axis of the base.

7. The modular hut of claim 6, wherein the reference point of the ring is a point where the ring couples to the seat portion, such that the seat portion is located at zero degrees relative to the reference axis when the ring is in the first position and is located at 90 degrees relative to the reference axis when the ring is in the second position.

8. The modular hut of claim 1, further comprising an inner ring portion coupled to at least a portion of the inner surface of the ring.

9. The modular hut of claim 1, wherein the base includes a pull-out drawer.

10. The modular hut of claim 1, wherein the plurality of attachment mechanisms includes a plurality of apertures located on the first side surface of the ring, each aperture configured to accommodate a corresponding removable protruding fastener.

11. A multi-unit modular hut, comprising:

a first unit including a first base, a first ring rotatably coupled to the first base, and a first seat portion coupled to an inner surface the first ring;

a second unit including a second base, a second ring rotatably coupled to the second base, and a second seat portion coupled to an inner surface the second ring; and a connection ring configured to couple the first unit to the second unit by directly coupling a first side surface of the connection ring to a first side surface of the first ring and by directly coupling a second side surface of the connection ring to a first side surface of the second ring.

12. The multi-unit modular hut of claim 11, wherein the connection ring includes a table unit comprising a table base and a collapsible table top.

13. The multi-unit modular hut of claim 11, wherein the connection ring includes a lamp.

14. The multi-unit modular hut of claim 11, wherein:

the connection ring includes a first set of apertures located on the first side surface of the connection ring and a second set of apertures located on the second side surface of the connection ring;

the first unit includes a third set of apertures located on the first side surface of the first ring;

the second unit includes a fourth set of apertures located on the first side surface of the second ring; and when the connection ring is coupling the first unit to the second unit, the connection ring is coupled to the first unit via a first set of removable protruding fasteners coupled between the first set of apertures and the third set of apertures and is coupled to the second unit via a second set of removable protruding fasteners coupled between the second set of apertures and the fourth set of apertures.

15. The multi-unit modular hut of claim 11, wherein the connection ring is fixedly coupled to a connection base.

16. The multi-unit modular hut of claim 11, wherein when the connection ring is coupling the first unit to the second unit, the first seat portion is in a first position and the second seat portion is in a second position that is flipped horizontally with respect to the first position.

* * * * *